US009162839B2

(12) United States Patent
Yoshida et al.

(10) Patent No.: US 9,162,839 B2
(45) Date of Patent: Oct. 20, 2015

(54) SHEET PROCESSING APPARATUS AND IMAGE FORMING SYSTEM

(71) Applicants: Ryuji Yoshida, Kanagawa (JP); Nobuyoshi Suzuki, Tokyo (JP); Yuusuke Shibasaki, Kanagawa (JP); Katsuhiro Kosuge, Kanagawa (JP); Hidehiko Fujiwara, Tokyo (JP); Makoto Hidaka, Tokyo (JP); Wataru Takahashi, Tokyo (JP); Takuya Morinaga, Tokyo (JP)

(72) Inventors: Ryuji Yoshida, Kanagawa (JP); Nobuyoshi Suzuki, Tokyo (JP); Yuusuke Shibasaki, Kanagawa (JP); Katsuhiro Kosuge, Kanagawa (JP); Hidehiko Fujiwara, Tokyo (JP); Makoto Hidaka, Tokyo (JP); Wataru Takahashi, Tokyo (JP); Takuya Morinaga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/500,875

(22) Filed: Sep. 29, 2014

(65) Prior Publication Data

US 2015/0091246 A1 Apr. 2, 2015

(30) Foreign Application Priority Data

Sep. 30, 2013 (JP) ..... 2013-204652
Jun. 24, 2014 (JP) ..... 2014-128818

(51) Int. Cl.
*B65H 29/12* (2006.01)
*B65H 33/08* (2006.01)

(52) U.S. Cl.
CPC ..... *B65H 29/125* (2013.01); *B65H 33/08* (2013.01)

(58) Field of Classification Search
CPC ..... B65H 29/125; B65H 33/06; B65H 33/08
USPC ..... 271/314, 207; 414/791.2
See application file for complete search history.

(56) References Cited

U.S. PATENT DOCUMENTS

| | | | | |
|---|---|---|---|---|
| 5,513,839 | A * | 5/1996 | Green | 270/58.07 |
| 2004/0145112 | A1* | 7/2004 | Matsutomo et al. | 271/207 |
| 2004/0181309 | A1* | 9/2004 | Matsumoto et al. | 700/223 |
| 2006/0181006 | A1* | 8/2006 | Funada | 271/207 |
| 2007/0102874 | A1* | 5/2007 | Matsutomo et al. | 271/286 |
| 2011/0100187 | A1* | 5/2011 | Kato et al. | 83/732 |
| 2013/0300055 | A1* | 11/2013 | Ishikawa et al. | 271/227 |
| 2013/0341856 | A1* | 12/2013 | Takemasa et al. | 271/220 |

FOREIGN PATENT DOCUMENTS

| | | |
|---|---|---|
| JP | 2004-161489 | 6/2004 |
| JP | 2005-263424 | 9/2005 |

* cited by examiner

*Primary Examiner* — David H Bollinger
(74) *Attorney, Agent, or Firm* — Duft Bornsen & Fettig LLP

(57) ABSTRACT

A sheet processing apparatus includes: a loading tray on which a sheet is loaded; a pair of ejection rollers that eject the sheet to the loading tray and in which a pair or roller members are configured to be able to contact with and separate from each other; a pair of shift rollers that is provided upstream of the pair of ejection rollers in a sheet conveyance direction, are movable in a sheet width direction that is a direction perpendicular to the sheet conveyance direction, convey the sheet towards the loading tray, and performs a shift operation of shifting the sheet to a different position in the sheet width direction; and a control unit that performs control to change, based on sheet information, a shift operation timing of the sheet by the pair of shift rollers and a contacting and separating timing of the pair of ejection rollers.

5 Claims, 20 Drawing Sheets

101
102
201
202
203
203a
203b
204
205
205a
205b
206
207
208
209
210
211
220
222
240
241
242
261
P 101
102
201
202
203
203a
203b
204
205
205a
205b
206
207
208
209
210
211
220
222
240
241
242
261
P

SHEET PROCESSING APPARATUS AND IMAGE FORMING SYSTEM

CROSS-REFERENCE TO RELATED APPLICATIONS

The present application claims priority to and incorporates by reference the entire contents of Japanese Patent Application No. 2013-204652 filed in Japan on Sep. 30, 2013 and Japanese Patent Application No. 2014-128818 filed in Japan on Jun. 24, 2014.

BACKGROUND OF THE INVENTION

1. Field of the Invention

The present invention relates to a sheet processing apparatus that performs a predetermined process on a sheet, such as a paper sheet, and to an image forming system that includes the sheet processing apparatus.

2. Description of the Related Art

Conventionally, as an image forming system, one that includes a sheet processing apparatus that is able to sort sheets on which images have been generated by an image forming apparatus has been know.

A sheet processing apparatus described in Japanese Patent No. 4063704 includes: a paper ejection tray on which paper sheets, which are sheets ejected from an outlet of a main body of the apparatus, are to be loaded; and a pair of paper ejection rollers, which eject the paper sheets to the paper ejection tray and in which a pair of roller members are configured to be able to come into contact with and separate from each other. Further, a pair of shift rollers are included, which are provided upstream of the pair of paper ejection rollers in a sheet conveyance direction, are movable in a paper sheet width direction, convey the paper sheets towards the paper ejection tray, and perform a shift operation of shifting the paper sheets to different positions in the paper sheet width direction.

During the shift operation on the paper sheets by the pair of shift rollers, the pair of paper ejection rollers are separated from each other, and after the shift operation is completed, the pair of paper ejection rollers are abutted onto each other to convey the paper sheets while holding the paper sheets therebetween and eject the paper sheets to the paper ejection tray. When the paper sheets ejected by the pair of paper ejection rollers are loaded on the paper ejection tray, the paper sheets are distributed to left and right in paper the sheet width direction by a predetermined amount by the pair of shift rollers to load the paper sheets onto different shift positions on the paper ejection tray.

However, conventionally, controlling the shift operation has been carried out in the same way regardless of a type of the sheets, and thus, depending on the type of sheets, if the shift operation is controlled as described above, failure in the loading of the sheets may be caused. For example, if sheets not having enough firmness as sheets are used and the shift operation is controlled as described above, the following problems may be caused.

Specifically, since the paper sheets are conveyed while being shifted by the pair of shift rollers in a state in which the pair of paper ejection rollers are separated, a paper sheet leading end side is not held by the pair of paper ejection rollers and only a paper sheet tail end side is held by the pair of shift rollers, providing no firmness at the paper sheet leading end side. Therefore, the paper sheet leading end side not provided with firmness is largely hung down towards the paper ejection tray.

After the shift operation on the paper sheets by the pair of shift rollers is completed, the pair of paper ejection rollers are caused to come into contact with each other and the paper sheets are conveyed while being held between the pair of paper ejection rollers. However, if the paper sheets are conveyed by the pair of paper ejection rollers in a state in which the paper sheet leading end side not provided with firmness is largely hung down towards the paper ejection tray, when a sheet leading end contacts the paper ejection tray, there is a risk that curling may occur at the sheet leading end side and failure in the loading of the paper sheets may be caused.

In view of the above, there is a need to provide a sheet processing apparatus, which is able to suppress failure in loading of sheets that have been subjected to a shift operation, regardless of a type of the sheets, as well as an image forming system including the sheet processing apparatus.

SUMMARY OF THE INVENTION

It is an object of the present invention to at least partially solve the problems in the conventional technology.

A sheet processing apparatus includes: a loading tray on which a sheet is loaded on a sheet loading surface thereof; a pair of ejection rollers that eject the sheet to the loading tray and in which a pair or roller members are configured to be able to contact with and separate from each other; a pair of shift rollers that is provided upstream of the pair of ejection rollers in a sheet conveyance direction, are movable in a sheet width direction that is a direction perpendicular to the sheet conveyance direction, convey the sheet towards the loading tray, and performs a shift operation of shifting the sheet to a different position in the sheet width direction; and a control unit that performs control to change, based on sheet information, a shift operation timing of the sheet by the pair of shift rollers and a contacting and separating timing of the pair of ejection rollers.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 2:
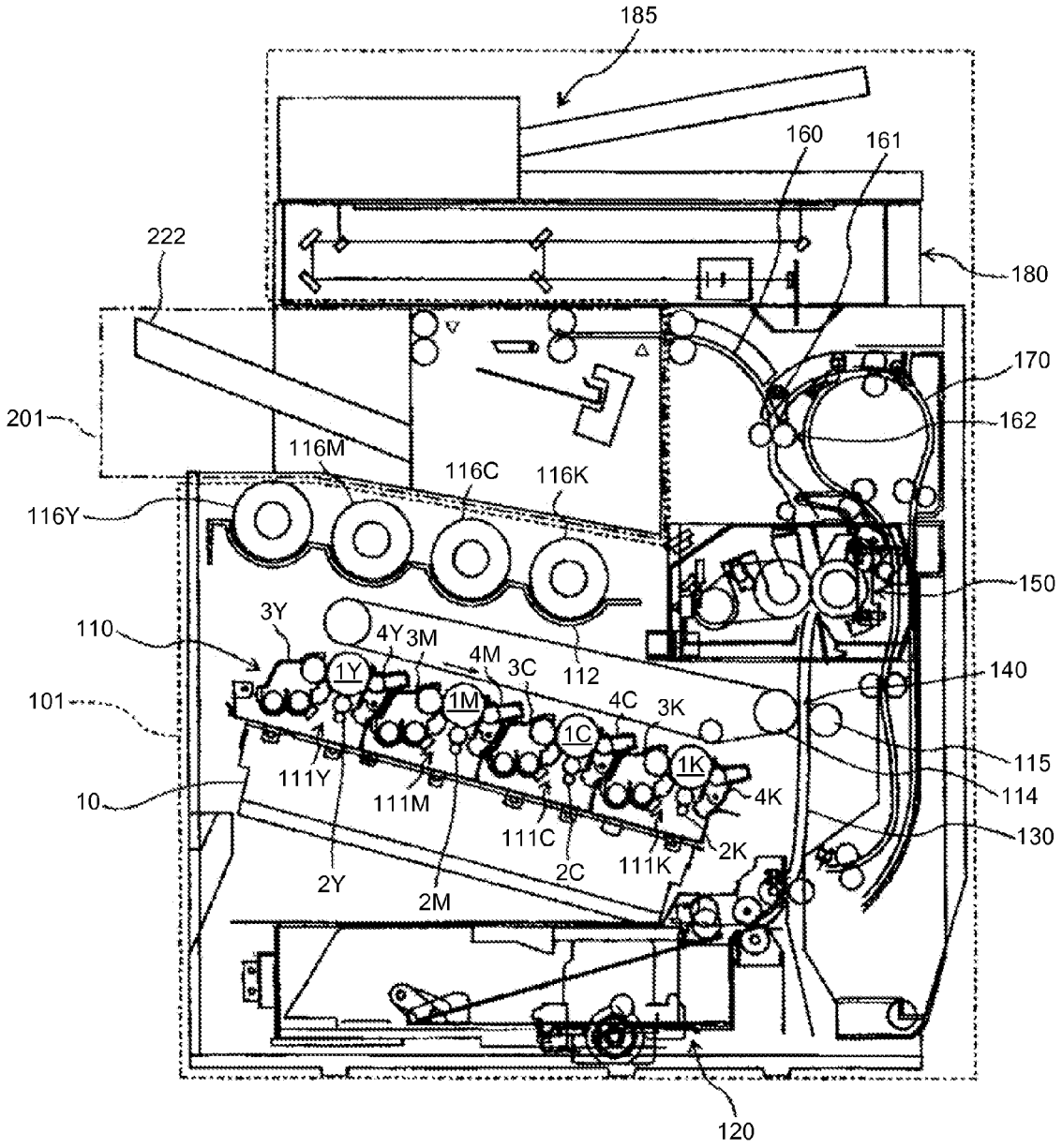
FIG. 2 is a diagram of a schematic configuration of an image forming system according to the embodiment.

FIG. 2 is a diagram of a schematic configuration of an image forming apparatus 101 and a paper sheet postprocessing apparatus 201, which is a sheet processing apparatus, of an image forming system 100 according to an embodiment.

In FIG. 2, the image forming apparatus 101 is a tandem color image forming apparatus of an indirect transfer system using an intermediate transfer body. At an approximate center of the image forming apparatus 101, an image forming unit 110, which is a toner image forming unit, is arranged.

The image forming unit 110 has image forming stations 111Y, 111M, 111C, and 111K (hereinafter, as appropriate, the appended letters Y, M, C, and K will be omitted) of four colors (Y: yellow, M: magenta, C: cyan, and K: black), which are arranged in a line along a predetermined direction.

Further, the image forming apparatus 101 includes a paper feeding tray 120, which is a plurality of paper feeding unit provided, as a recording medium supplying unit, below the image forming unit 110. Furthermore, a paper feeding conveyance path (vertical conveyance path) 130 is included, which conveys a paper sheet that is a recording medium picked up by the paper feeding tray 120 to a secondary transfer unit 140 and a fixing unit 150.

Moreover, the image forming apparatus 101 includes a bifurcating paper ejection path 160 that conveys the paper sheet, on which an image (toner image) has been fixed, towards the paper sheet postprocessing apparatus 201, and a double side conveyance path 170 for reversing a paper sheet on which an image has been formed on a first side (front side) thereof and forming an image on a second side (reverse side) thereof.

In addition, the image forming apparatus 101 includes a scanner unit 180, which is an image reading unit, and an automatic document feeder (ADF) 185, which is a document supplying unit.

The scanner unit 180 reads an image on a document, which is to be subjected to image reading and is set on a glass surface that is a document table, and converts the image into an electric signal.

Further, in the automatic document feeder (ADF) 185, one document or a plurality of documents to be subjected to image reading by the scanner unit 180 is or are set, and the automatic document feeder (ADF) 185 conveys each document so that the document is fed onto the glass surface, which is at a reading position of the scanner unit 180.

The image forming unit 110 includes photoconductor drums 1Y, 1M, 1C, and 1K, which are image bearers for respective Y, M, C, and K colors of the image forming station 111.

Around the respective photoconductor drums 1Y, 1M, 1C, and 1K, charging units 2Y, 2M, 2C, and 2K, developer units 3Y, 3M, 3C, and 3K, and non-illustrated primary transfer units, cleaning units 4Y, 4M, 4C, and 4K, and non-illustrated discharging units are included.

Further, the image forming unit 110 includes an optical writing unit 10, which is an exposure unit, and an intermediate transfer belt 112, which is an intermediate transfer body.

The optical writing unit 10 is arranged below each image forming station 111 and for each color, based on image data generated from a result of the reading by the scanner unit 180, irradiates each photoconductor drum 1 with light and forms electrostatic latent images.

The intermediate transfer belt 112 is arranged above the image forming station 111, and an image (toner image) formed on each photoconductor drum 1 is transferred by the primary transfer unit.

The intermediate transfer belt 112 is rotatably supported by a plurality of supporting rollers. A supporting roller 114, which is one of the plurality of supporting rollers, is opposite to the secondary transfer roller 115 via the intermediate transfer belt 112, at the secondary transfer unit 140.

By this secondary transfer unit 140, the image (toner image) on the intermediate transfer belt 112 is secondarily transferred onto a paper sheet. Above the intermediate transfer belt 112, toner containers 116Y, 116M, 116C, and 116K, which accommodate toners supplied to respective developing units 3 and are replaceable, are arranged.

Further, a control unit, which controls an operation of each device in the image forming apparatus 101 and is not illustrated, is included.

An image forming process of the image forming apparatus 101 having the above configuration (the tandem color image forming apparatus of the indirect transfer system) is known and not directly related to the substance of the present invention, and thus a detailed description thereof will be omitted.

A fixed paper sheet that has been subjected to the fixing process by the fixing unit 150 is conveyed by a conveyance roller 162 and a conveyance direction thereof is switched over by a conveyance path switch over member 161. Thereby, the paper sheet that has been subjected to the fixing is conveyed to the bifurcating paper ejection path 160 or the double side conveyance path 170.

The paper sheet postprocessing apparatus 201 of this embodiment includes a conveyance path binding mechanism that is a paper sheet binding unit that binds, as postprocessing on a plurality of paper sheets including a paper sheet with an image formed thereon, a paper sheet bundle, which is a sheet bundle including a plurality of paper sheets. Further, a control unit, which controls an operation of each member in the paper sheet postprocessing apparatus 201 and is not illustrated, is also included.

The conveyance path binding mechanism has: a structure that performs superposition alignment of paper sheets in a paper sheet conveyance path; and a binding implement, which is a binding unit that binds the superposed paper sheets.

Figure 3:
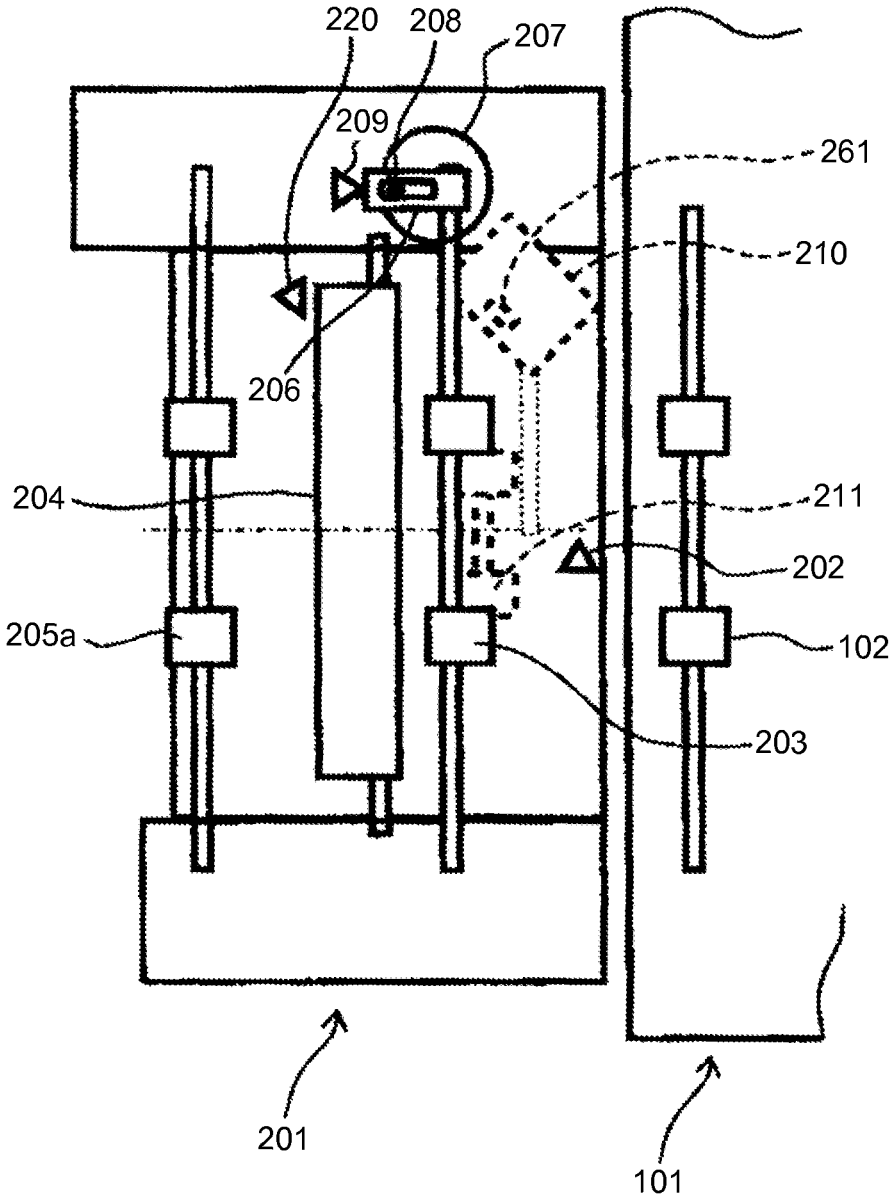
FIG. 3 is a plan view illustrating an example of a configuration of a paper sheet postprocessing apparatus of the image forming system according to the embodiment.
Figure 4:
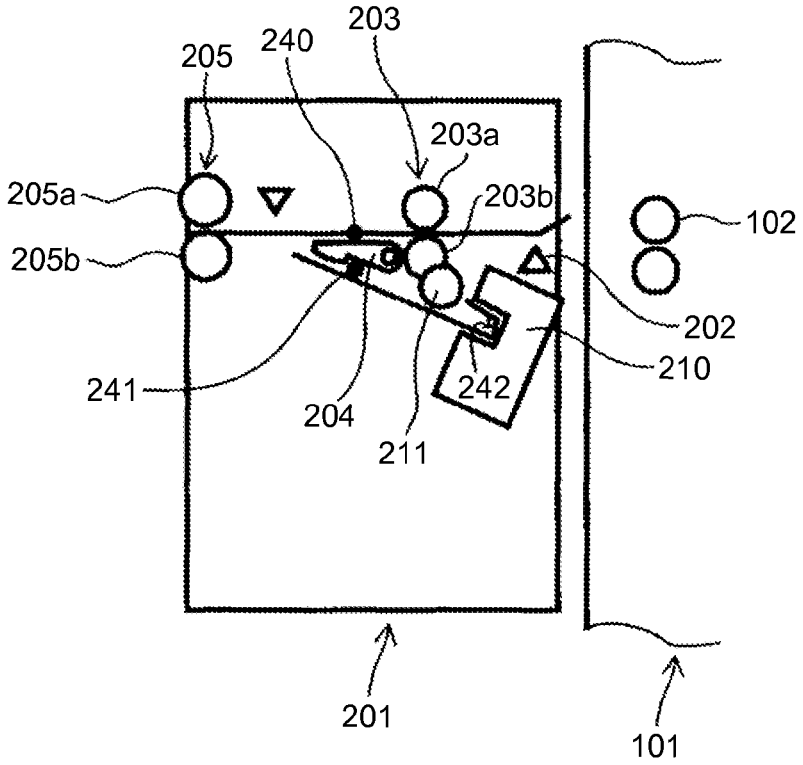
FIG. 4 is a front view illustrating the example of the configuration of the paper sheet postprocessing apparatus of the image forming apparatus according to the embodiment.

FIG. 3 is a plan view illustrating an example of a configuration of the paper sheet postprocessing apparatus 201 having the conveyance path binding mechanism included in the image forming system 100 of this embodiment. FIG. 4 is a front view illustrating the example of the configuration of the paper sheet postprocessing apparatus 201 having the conveyance path binding mechanism included in the image forming system 100.

The paper sheet postprocessing apparatus 201 includes an inlet sensor 202, a pair of inlet rollers 203, a bifurcating claw 204, a paper ejection drive roller 205*a*, a paper ejection driven roller 205*b*, and the like. Further, a shift link 206, a shift cam 207, a shift cam stud 208, a shift home position sensor 209, a binding implement 210, a returning roller 211, and the like are also included.

The inlet sensor 202 detects a leading end, a tail end, and presence or absence of a paper sheet conveyed into the paper sheet postprocessing apparatus 201 from the paper ejection roller 102 of the image forming apparatus 101.

The pair of inlet rollers 203 are formed of an inlet drive roller 203*a* and an inlet driven roller 203*b*, are positioned at an inlet of the paper sheet postprocessing apparatus 201, and have a function of conveying a paper sheet to the paper sheet postprocessing apparatus 201. Abutment skew correction of a paper sheet using a roller nip of the pair of inlet rollers 203 is also possible.

The inlet drive roller 203*a* of the pair of inlet rollers 203 is driven by a controllable drive source not illustrated. This drive source is controlled by a control unit, and thereby, rotational drive and stop of the pair of inlet rollers 203 by the drive source, and an amount of paper sheet conveyance by the pair of inlet rollers 203 are controlled. The control unit may be provided in the image forming apparatus 101.

The bifurcating claw 204 is a turnable claw, which switches over a conveyance path provided in order to guide a tail end of a paper sheet to a bifurcated path 241. Further, the bifurcating claw 204 is configured to be able to press the paper sheet onto a bifurcated path conveyance surface, and is able to immobilize the paper sheet by this pressing.

The paper ejection drive roller 205*a*, which is a drive conveyance member, is positioned at an outlet of the paper sheet postprocessing apparatus 201, has a function of conveying and ejecting a paper sheet, and comes into contact with the paper ejection driven roller 205*b*, which is a driven conveyance member, to form a conveyance nip.

Further, the paper ejection drive roller 205*a* is driven by a controllable drive source not illustrated. This drive source is controlled by a control unit, and thereby, rotational drive and stop of the paper ejection drive roller 205*a* by the drive source, and an amount of paper sheet conveyance by the paper ejection drive roller 205*a* are controlled.

The shift link 206 is provided at a shaft end of the inlet drive roller 203*a* and is a part that receives a moving force of a shift.

The shift cam 207 has the shift cam stud 208 and is a disk shaped part that rotates. By the rotation of this part, the inlet drive roller 203*a* coupled to a long hole portion of the shift link 206 via the shift cam stud 208 is shifted.

The shift cam stud 208 is interlocked with the long hole portion of the shift link 206 and changes rotational movement of the shift cam 207 to linear motion movement in a shaft direction of the inlet drive roller 203*a*.

The shift home position sensor 209 detects a position of the shift link 206 and determines this detected position as a home position (standby position).

The binding implement 210, which is a paper sheet processing unit, is a tool or a device that binds a paper sheet bundle by drawing and crimping processing without using a metallic needle.

In this embodiment, the binding implement 210 is used, which, by holding a paper sheet bundle between a pair of tooth dies having concavity and convexity on their surfaces, deforms the paper sheets and entwine fibers thereof with one another. As the binding implement 210 of this type, a known binding implement as disclosed in Japanese Examined Utility Model Application Publication No. S36-013206 may be used.

Further, a binding implement that binds a paper sheet bundle without using a metallic needle by cutting the paper bundle in a U-shape and bending the cut portion, simultaneously opening a slit near the bent portion, and passing a distal end portion of the cut and bent portion through the slit to prevent loosening (for example, see Japanese Examined Utility Model Application Publication No. S37-007208).

The binding unit to bind a paper sheet bundle is not limited to the binding implement of this embodiment, and may be any means having a binding function by drawing and pressure joining processing of pressure joining among paper sheets and entwining fibers of the paper sheets with one another.

The returning roller 211 conveys a paper sheet guided to the bifurcated path 241 towards an abutted surface 242. The returning roller 211 has a conveyance force to an extent that after the paper sheet abuts the abutted surface 242, the returning roller 211 is able to slip with respect to the paper sheet.

A paper sheet end sensor 220, which is a paper sheet end detecting unit, is a sensor that detects a side end of a paper sheet. When the paper sheets are aligned with one another, the paper sheets are aligned with one another with reference to a detected position detected by this sensor.

A conveyance path 240 is a normal path that conveys and ejects a received paper sheet. The bifurcated path 241 is a conveyance path, which is provided in order to superpose and align paper sheets, and into which a paper sheet is conveyed from a tail end side thereof by switch back of the paper sheet.

The abutted surface 242 is a reference surface for abutting and aligning tail ends of paper sheets at a binding process tray (staple tray) 243, which is a temporary loading unit on which the paper sheets to be bound are loaded temporarily. The tooth dies 261 in this embodiment for example, are tooth dies shaped such that a pair of a concave and a convex engage with each other, and by holding the paper sheets therebetween, the tooth dies 261 deform the paper sheets and entwine their fibers with one another.

Figure 5:
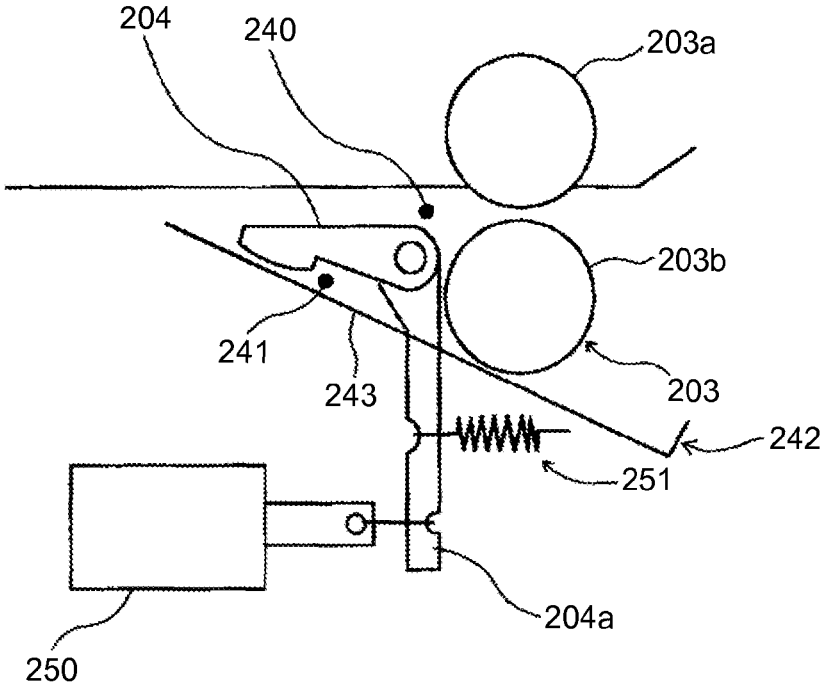
FIG. 5 is an explanatory diagram illustrating a home position of a bifurcating claw that bifurcates paper sheets received by the paper sheet postprocessing apparatus.
Figure 6:
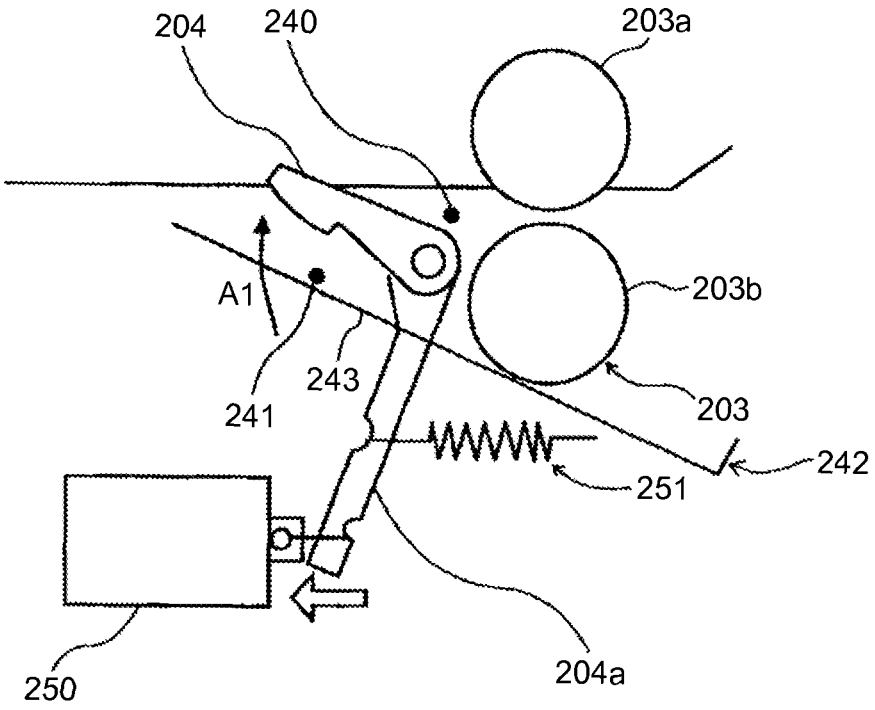
FIG. 6 is an explanatory diagram illustrating a position of the bifurcating claw when a sheet received by the paper sheet postprocessing apparatus is bifurcated to a bifurcated path.

FIG. 5 and FIG. 6 are each an explanatory diagram illustrating an example of a detailed configuration of the bifurcating claw 204, which bifurcates a sheet received by the paper sheet postprocessing apparatus 201, and of surroundings thereof. FIG. 5 is an explanatory diagram illustrating a home position of the bifurcating claw 204. Further, FIG. 6 is an explanatory diagram illustrating a position of the bifurcating claw when the paper sheet received by the paper sheet postprocessing apparatus 201 is bifurcated to the bifurcated path 241.

The bifurcating claw 204 is configured to be turnable in order to switch over between the conveyance path 240 and the bifurcated path 241. As illustrated in FIG. 5, a rotational position, at which the paper sheet received from a right side of the figure is conveyable without resistance, is the home position of the bifurcating claw 204.

The bifurcating claw 204 is always pressurized by a spring 251 as illustrated in FIG. 5. The spring 251 is hooked on a bifurcating claw movable lever portion 204*a*. A bifurcating solenoid 250 is also coupled to the bifurcating claw movable lever portion 204*a* via a link. Further, the conveyance surface of the bifurcated path 241 and the bifurcating claw 204 are configured to be able to hold a paper sheet in the conveyance path therebetween.

Upon the switch over between the conveyance paths, by turning the bifurcating solenoid 250 ON, the bifurcating claw 204 is turned in a direction of an arrow A1 in FIG. 6, closes the conveyance path 240, and guides a paper sheet to the bifurcated path 241.

Figure 7:
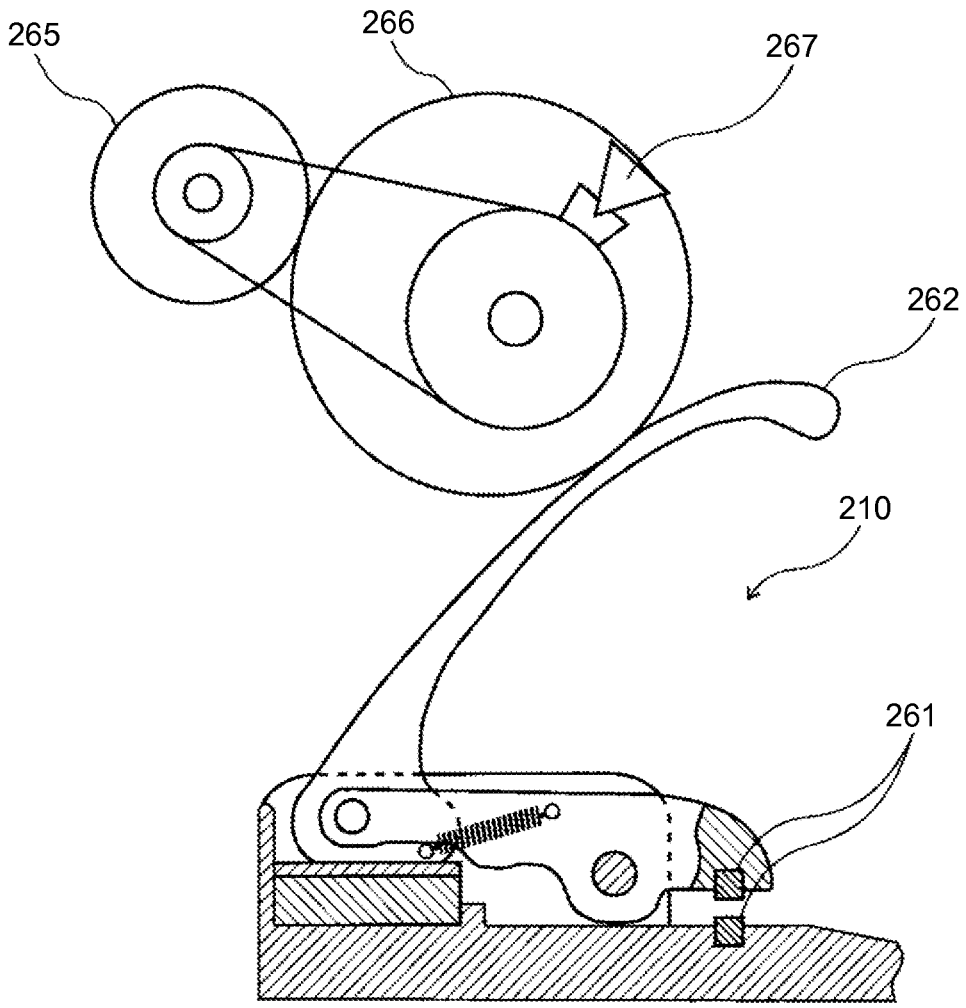
FIG. 7 is an explanatory diagram illustrating an example of a binding implement with tooth dies being open and a drive mechanism thereof.
Figure 8:
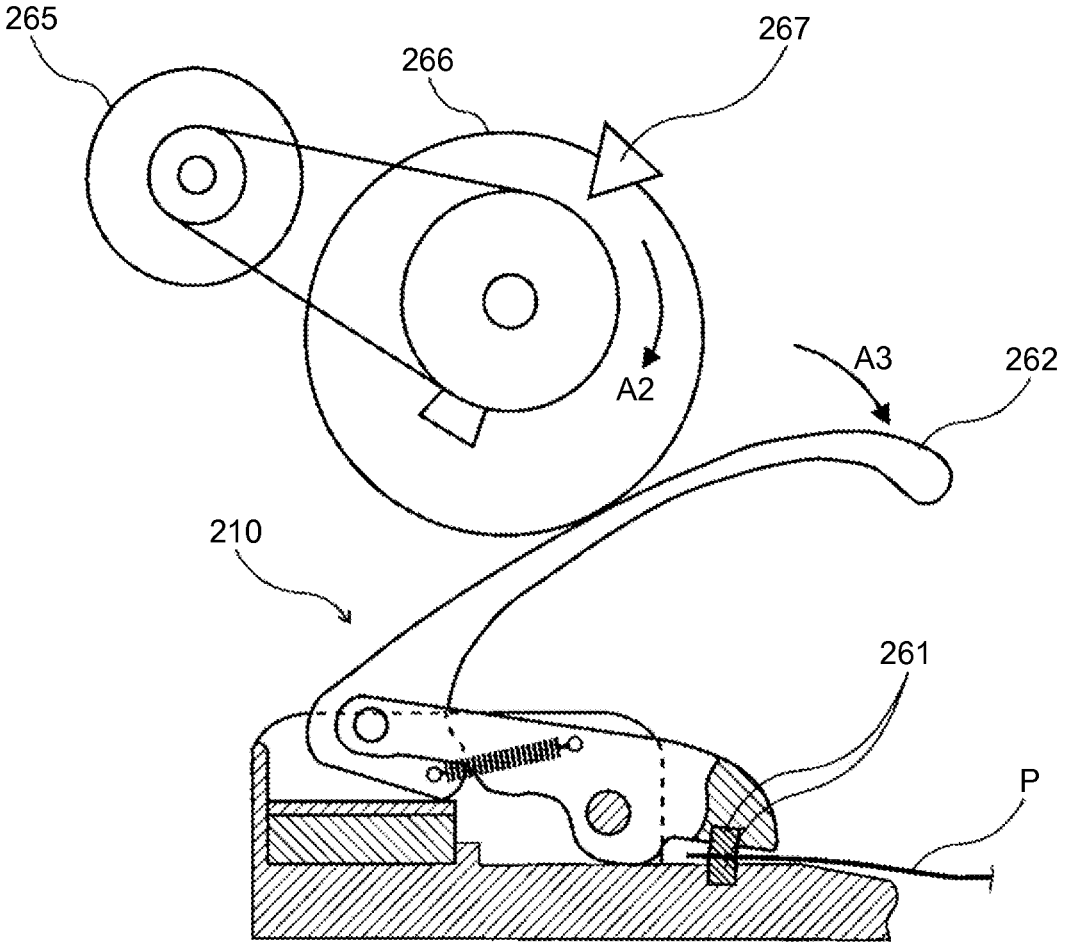
FIG. 8 is an explanatory diagram illustrating an example of the binding implement with the tooth dies being closed and the drive mechanism thereof.

FIG. 7 and FIG. 8 are each an explanatory diagram illustrating an example of a configuration and an operation of the binding implement 210. FIG. 7 is an explanatory diagram illustrating an example of the binding implement 210 and a drive mechanism thereof in a state in which the tooth dies 261 are open, and FIG. 8 is an explanatory diagram illustrating an example of the binding implement 210 and the drive mechanism thereof in a state in which the tooth dies 261 are closed. A configuration of the binding implement 210 is not limited to the configuration of FIG. 7 and FIG. 8.

In FIG. 7, the tooth dies 261 are shaped such that the tooth dies 261 are engaged with each other in a top and bottom pair. These tooth dies 261 are arranged at an end of a group of a plurality of combined links and are configured to come into contact with and separate from each other by turning of a pressurizing lever 262.

The pressurizing lever 262 turns in a direction of an arrow A3 in FIG. 8 by a cam 266 that rotates in a direction of an arrow A2 in FIG. 8. This cam 266 receives a drive force by a drive motor 265 and is rotated, and based on detected information by a cam home position sensor 267, is controlled to be positioned at its detection position. The detected position by the cam home position sensor 267 is treated as a home position (standby position) of the cam 266 and at this position, the tooth dies 261 are in an open state.

When paper sheets are bound, the operation as illustrated in FIG. 8 is performed. In a state in which the pair of tooth dies 261 are open, paper sheets P are inserted therebetween, and the cam 266 is rotated in the direction of the arrow A2 in FIG. 8 by rotation of the drive motor 265. By this displacement of a cam surface, the pressurizing lever 262 is turned in the direction of the arrow A3 in the figure. This rotational force increases in force via the link group utilizing leverage and is transmitted to the tooth dies 261 at an end portion thereof.

The tooth dies 261 are engaged with each other upon rotation of the cam 266 by a predetermined amount, and hold the paper sheets P therebetween. By this holding, the paper sheets P are deformed and pressurized, fibers of adjacent paper sheets are entwined with one another, and the paper sheets P are bound together.

Thereafter, the drive motor 265 counter-rotates and stops at the detected position of the cam home position sensor 267. Further, the pressurizing lever 262 has spring and is bent when an overload is placed thereon, such that the overload is released.

In the binding implement 210 having the configuration illustrated in FIG. 7 and FIG. 8, a binding force, which is a force with which the tooth dies 261 holding the paper sheets P therebetween to deform and pressurize the paper sheets P engage with each other, changes, and a binding strength upon binding of a paper sheet bundle by fibers of the paper sheets entwining with one another changes.

The binding force upon the engagement of the tooth dies 261 changes according to a rotational force (torque) for turning the pressurizing lever 262 via the cam 266, that is, a torque (a moment of force) generated by the drive motor 265.

The torque generated by the drive motor 265 changes according to a motor electric current supplied to the drive motor 265. Therefore, by controlling the motor electric current supplied to the drive motor 265, the binding force of the binding implement 210 is able to be changed, and the binding strength of the paper sheet bundle is able to be changed, according to binding modes, such as a non-temporary binding mode and a temporary binding mode.

Next, an example of a binding operation of the paper sheet postprocessing apparatus 201 will be described.

FIG. 9A to FIG. 17B are plan views and front views of the paper sheet postprocessing apparatus 201 executing a binding operation of this example. In each of FIG. 9A to FIG. 17B, a partial figure A is the plan view of the paper sheet postprocessing apparatus 201 and a partial figure B is a front view of the paper sheet postprocessing apparatus 201.

Figure 9A:
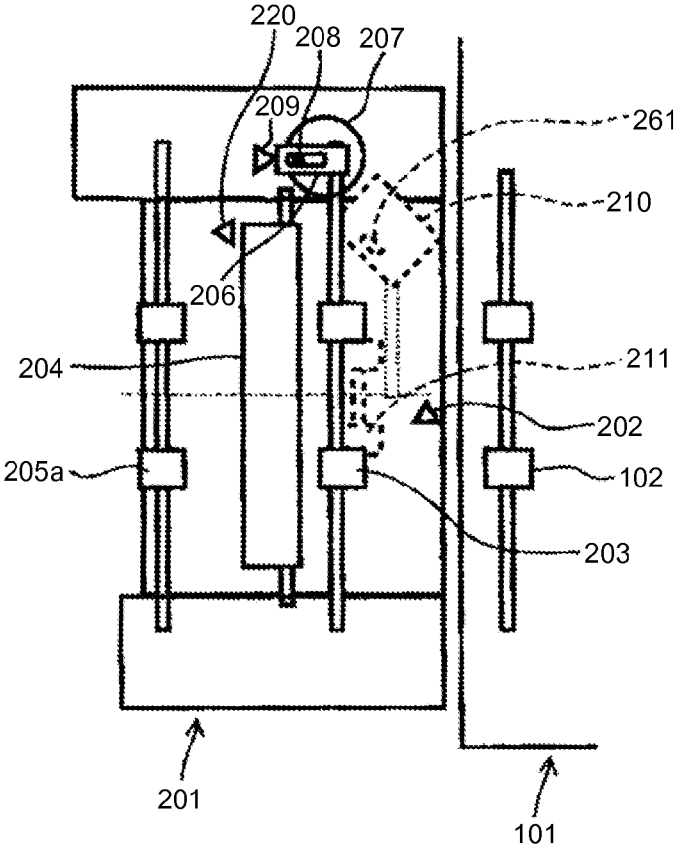
FIG. 9A is a plan view illustrating a state of inside of the paper postprocessing apparatus in which an initialization process has been completed.
Figure 9B:
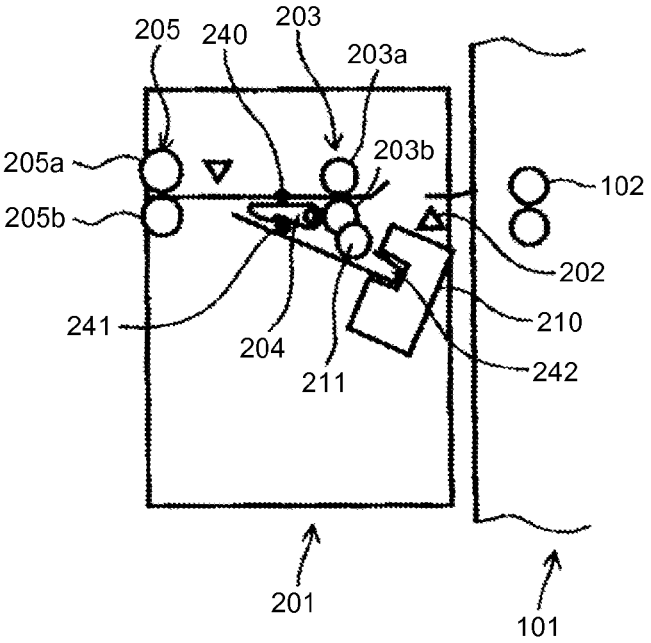
FIG. 9B is a front view illustrating the state of the inside of the paper postprocessing apparatus in which the initialization process has been completed.

First, in FIG. 9A and FIG. 9B, as a paper sheet is started to be output from the image forming apparatus 101, each unit moves to its home position and completes an initialization process (initial process).

Before the paper sheets P output from the image forming apparatus 101 is conveyed to the paper sheet postprocessing apparatus 201, the paper sheet postprocessing apparatus 201 receives information of an operation mode and information of the paper sheets P, and based on these pieces of information, enters a reception standby state. The operation modes in this embodiment include a straight mode, a shift mode, and a binding mode, but are not limited to these modes.

Operations of the paper sheet postprocessing apparatus 201 in the straight mode and the shift mode will be described.

First, operations of the paper sheet postprocessing apparatus 201 in the straight mode will be described.

The paper sheet postprocessing apparatus 201, which has received information of the straight mode and information of a paper sheet P, enters a reception standby state of the straight mode.

Specifically, the pair of inlet rollers 203 and the paper ejection drive roller 205*a* start rotation in respective predetermined rotation directions such that the received paper sheet P is conveyed to a predetermined conveyance direction (a left direction in the figure).

To the paper sheet postprocessing apparatus 201 in such a reception standby state, the paper sheet P is fed by rotation of the paper ejection roller 102 of the image forming apparatus 101. The paper sheet P that has been fed to the paper sheet postprocessing apparatus 201 is sequentially conveyed by the pair of inlet rollers 203 and a pair of paper ejection rollers 205 formed of the paper ejection drive roller 205*a* and the paper ejection driven roller 205*b* and is ejected to a paper ejection tray not illustrated. As the last paper sheet is ejected to the paper ejection tray, the pair of inlet rollers 203 and the paper ejection drive roller 205*a* stop.

Next, operations of the paper sheet postprocessing apparatus 201 in the shift mode will be described.

The paper sheet postprocessing apparatus 201, which has received information of the shift mode and information of a paper sheet P, enters a reception standby state of the shift mode.

Specifically, similarly to the straight mode, the pair of inlet rollers 203 and the paper ejection drive roller 205*a* start rotation in their respective predetermined rotation directions such that the received paper sheet P is conveyed to a predetermined direction (left direction in the figure).

To the paper sheet postprocessing apparatus 201 in such a reception standby state, the paper sheet P is fed from the image forming apparatus 101. The paper sheet fed to the paper sheet postprocessing apparatus 201 is conveyed by the pair of inlet rollers 203 and the pair of paper ejection rollers, similarly to the straight mode.

Next, before a tail end of the paper sheet comes out of the pair of inlet rollers 203, the shift cam 207 rotates by a certain amount and the inlet drive roller 203*a* moves in a shaft direction. As this happens, the paper sheet P also moves along with the movement of the inlet drive roller 203*a*.

When the paper sheet P is ejected to the paper ejection tray, the shift cam 207 rotates to return to the home position to prepare for the next paper sheet.

These operations of the inlet drive roller 203*a* are repeated until the paper sheets of the same "copy" are ejected to the paper ejection tray. If the paper sheets of the next "copy" are conveyed, the shift cam 207 rotates in a rotation direction opposite to the previous one and the paper sheets are moved and ejected to an opposite side.

Next, operations of the paper sheet postprocessing apparatus 201 in the binding mode will be described.

The paper sheet postprocessing apparatus 201, which has received information of the binding mode and information of a paper sheet P, enters a reception standby state of the binding mode.

Figure 10A:
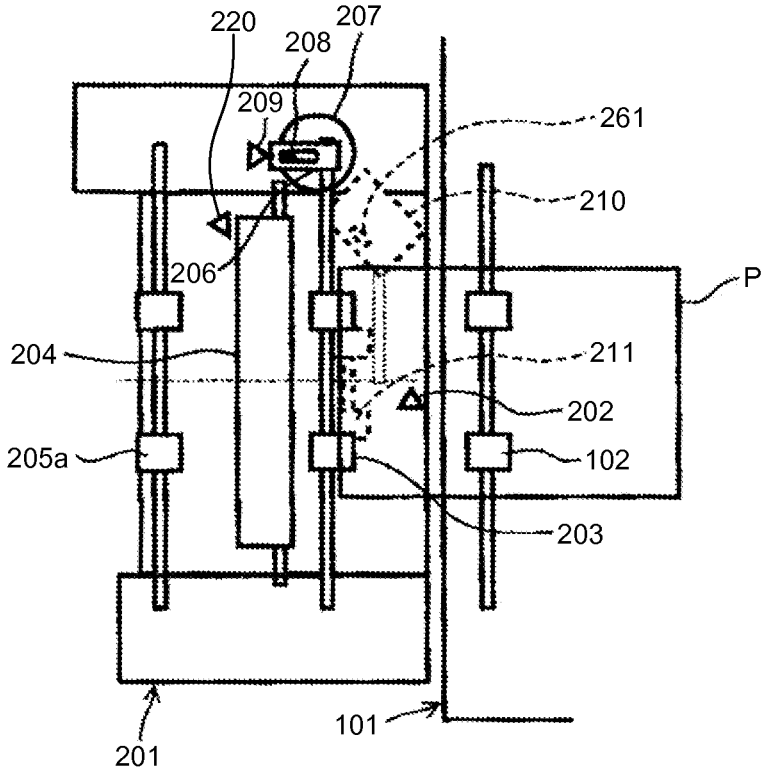
FIG. 10A is a plan view illustrating a state of inside of the paper postprocessing apparatus receiving paper sheets.
Figure 10B:
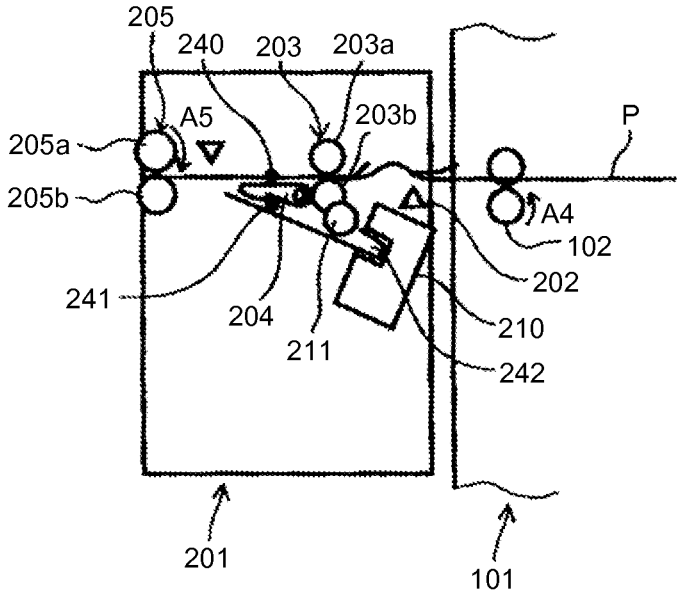
FIG. 10B is a front view illustrating the state of the inside of the paper postprocessing apparatus receiving the paper sheets.

In the reception standby state of the binding mode, rotation of the pair of inlet rollers 203 is stopped, and as illustrated in FIG. 10B, the paper ejection drive roller 205*a* rotates in a direction of an arrow A5 in the figure. Further, the binding implement 210 moves to and stands by at a standby position (home position) retreated by a predetermined amount from a width direction end portion of the paper sheet P.

To the image forming apparatus 101 in such a reception standby state, the paper sheet P is fed. A leading end of the paper sheet fed to the paper sheet postprocessing apparatus 201 is detected by the inlet sensor 202 and thereafter abuts the nip of the pair of inlet rollers 203.

After the paper sheet P is conveyed by a certain distance (a distance that causes bending of a certain amount by the leading end of the paper sheet P abutting the nip of the pair of inlet rollers 203) from the detection of the leading end by the inlet sensor 202, the pair of inlet rollers 203 start to rotate. Thereby, skew of the paper sheet P is corrected.

Figure 11A:
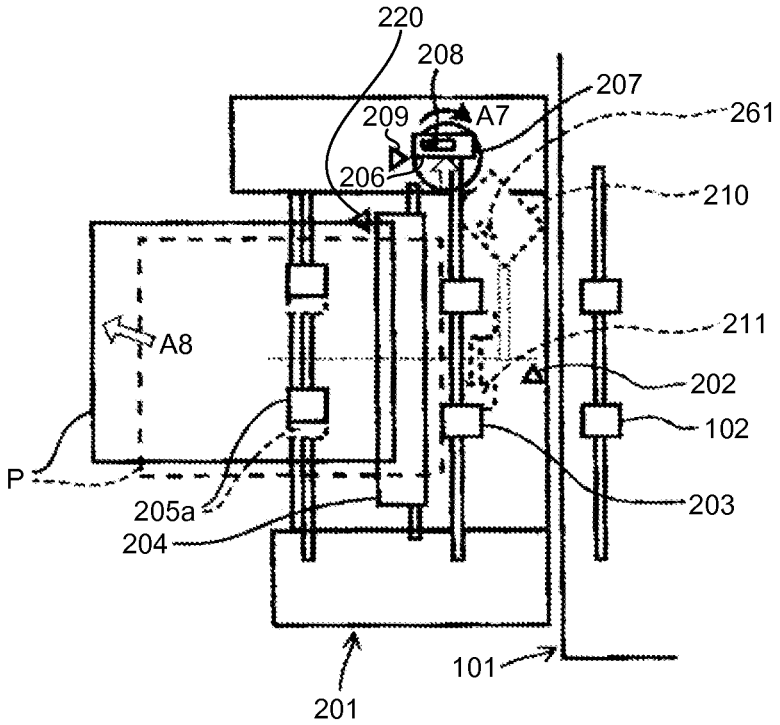
FIG. 11A is a plan view illustrating a state of inside of the paper postprocessing apparatus performing registration of a position of a paper sheet in a width direction.

The shift cam 207 then rotates in a direction of an arrow A7 in FIG. 11A (clockwise direction) and the inlet drive roller 203*a* starts movement in the shaft direction together with the paper sheet P. The paper sheet P is then conveyed in a direction of an arrow A8 in FIG. 11A while moving diagonally.

Figure 11B:
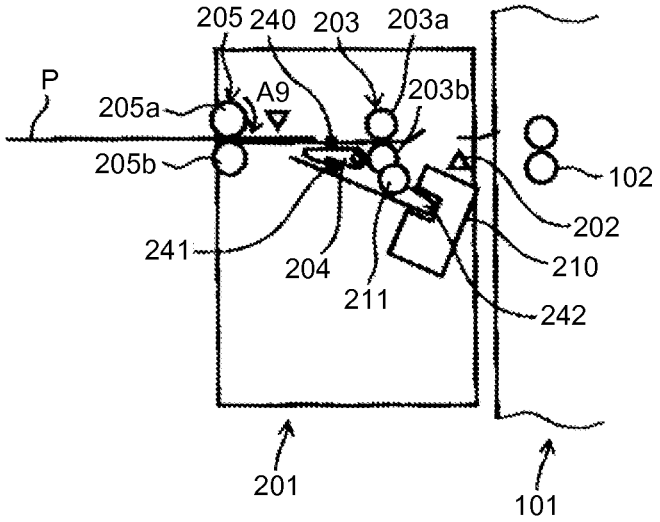
FIG. 11B is a front view illustrating the state of the inside of the paper postprocessing apparatus performing registration of the position of the paper sheet in the width direction.

In FIG. 11A and FIG. 11B, with reference to detected information of the inlet sensor 202, which has detected a tail end of the paper sheet P, an amount of conveyance of the paper sheet P is counted. Based on this counted information, a timing at which the tail end of the paper sheet P passes the nip of the pair of inlet rollers 203 is grasped, and when the tail end of the paper sheet P passes the nip of the pair of inlet rollers 203, the pair of inlet rollers 203 stop for receiving the next paper sheet.

Further, when the paper sheet end sensor 220 detects the paper sheet P, the shift cam 207 counter-rotates, after stopping. This counter-rotation of the shift cam 207 stops when the paper sheet end sensor 220 is put into a non-detecting state.

After the above operations are completed, at a predetermined position at which the tail end of the paper sheet P has passed a distal end of the bifurcating claw 204, the rotation of the paper ejection drive roller 205*a* in a direction of an arrow A9 in FIG. 11B stops.

Figure 12A:
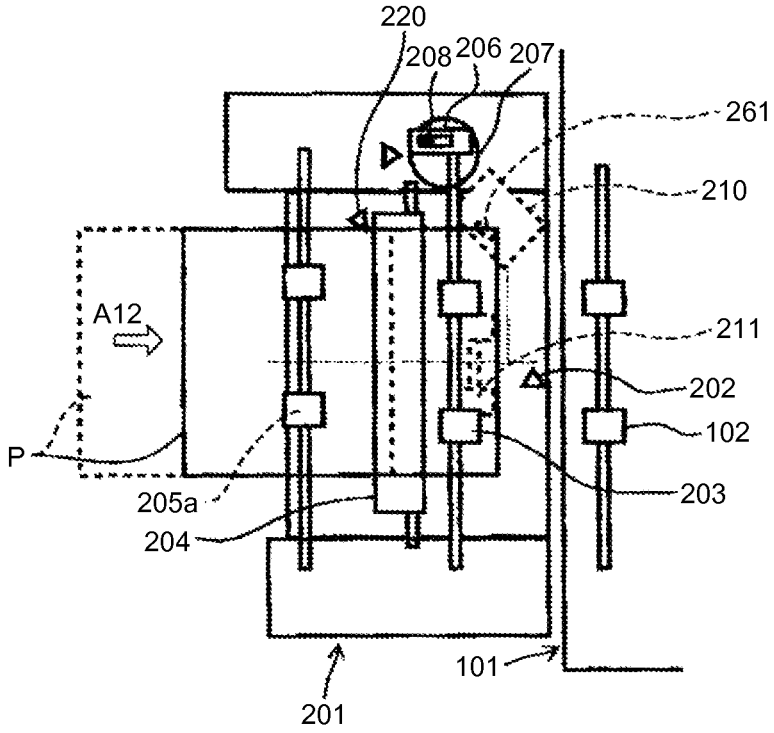
FIG. 12A is a plan view illustrating a state of inside of the paper postprocessing apparatus performing registration of a position of a tail end of a paper sheet.
Figure 12B:
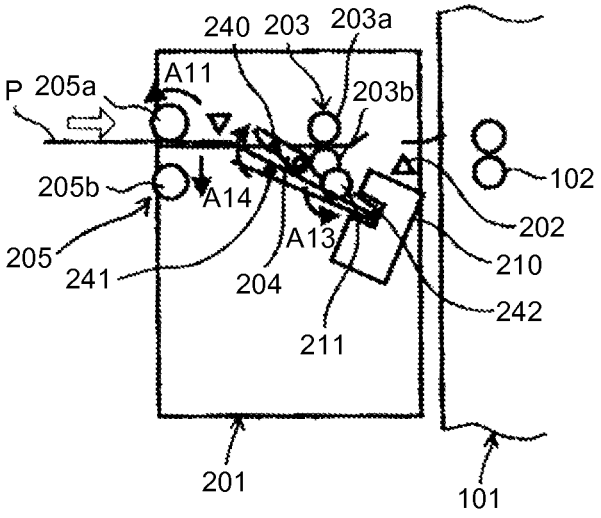
FIG. 12B is a front view illustrating the state of the inside of the paper postprocessing apparatus performing registration of the position of the tail end of the paper sheet.

Next, in FIG. 12A and FIG. 12B, the bifurcating claw 204 rotates in a direction of an arrow A10 in FIG. 12B (clockwise direction) and the conveyance path is switched over. Thereafter, the paper ejection drive roller 205*a* counter-rotates in a direction of an arrow A11 in FIG. 12B (anticlockwise direction) and the paper sheet P is conveyed in a direction of an arrow A12 in the figure such that a tail end portion of the paper sheet P is conveyed to the bifurcated path 241.

By this conveyance, when the tail end of the paper sheet P passes the returning roller 211, the returning roller 211 rotates in a direction of an arrow A13 in FIG. 12B (anticlockwise direction), and conveyance of the paper sheet P is handed over to the returning roller 211.

When the conveyance of the paper sheet P is handed over to the returning roller 211, the paper ejection driven roller 205*b* moves in a direction of arrow A14 in FIG. 12B and separates from the paper ejection drive roller 205*a*, and a conveyance nip thereof is released.

Next, by conveyance by the returning roller 211, the tail end of the paper sheet P is abutted against the abutted surface 242 of the binding process tray 243 to be aligned. When the tail end of the paper sheet P abuts against the abutted surface 242, rotational drive of the returning roller 211 stops.

The returning roller 211 has a conveyance force, which is set to be weak, such that the paper sheet P slips as the paper sheet P makes the abutment.

Figure 13A:
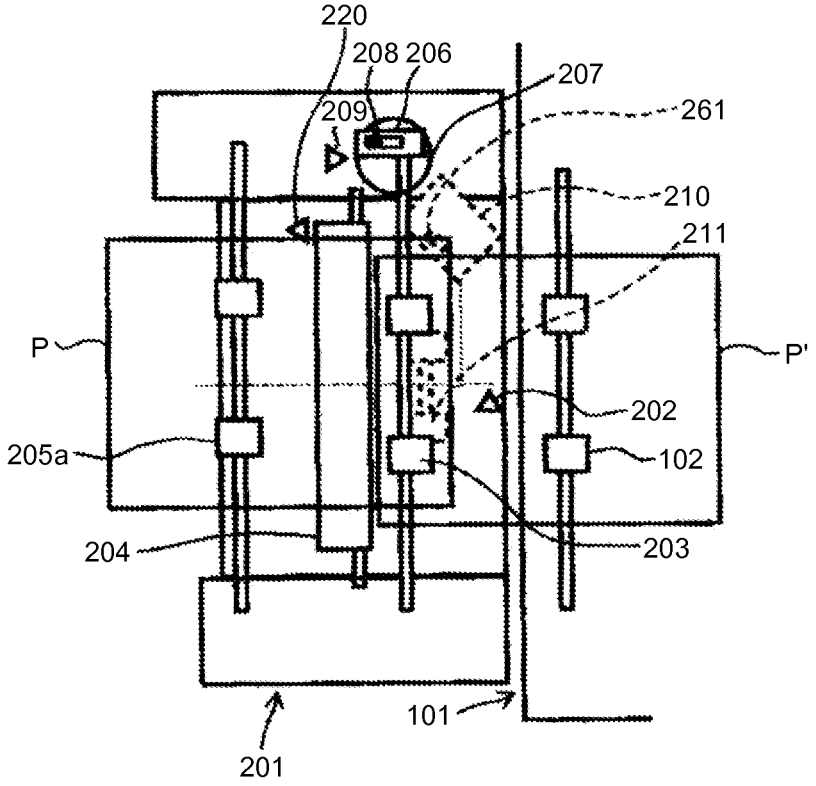
FIG. 13A is a plan view illustrating a state of inside of the paper postprocessing apparatus receiving a subsequent paper sheet.
Figure 13B:
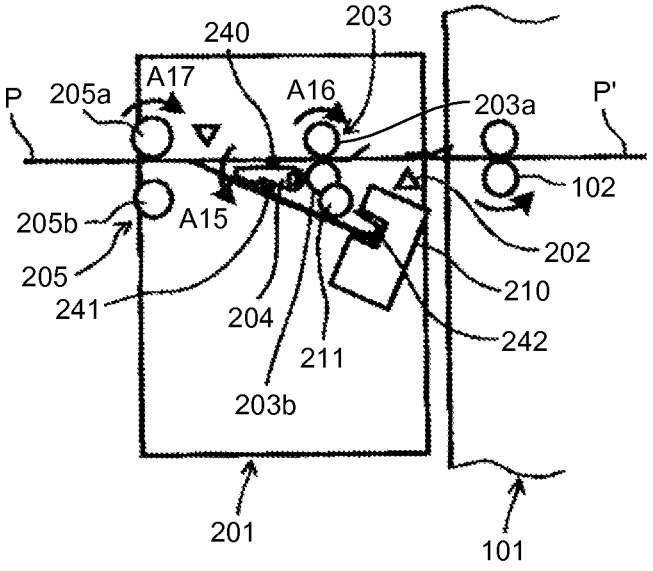
FIG. 13B is a front view illustrating the state of the inside of the paper postprocessing apparatus receiving the subsequent paper sheet.

Next, in FIG. 13A and FIG. 13B, the bifurcating claw 204 rotates in a direction of an arrow A15 in FIG. 13B (anticlockwise direction) and the tail end of the paper sheet P on the bifurcated path 241 is pressed with a strong force by a contact surface of the bifurcating claw 204 and waits.

When a subsequent paper sheet P' is output from the image forming apparatus 101, similarly to the first paper sheet P, an operation of performing skew correction of the paper sheet P' by the pair of inlet rollers 203 is performed.

After the skew correction, the pair of inlet rollers 203 are turned in a direction of an arrow A16 in FIG. 13B and the paper ejection drive roller 205*a* is turned in a direction of an arrow A17 in FIG. 13B. As this happens, as illustrated in FIG. 13B, the paper ejection driven roller 205*b* is separated from the paper ejection drive roller 205*a* and the conveyance nip therebetween is still in a state of being released.

Figure 14A:
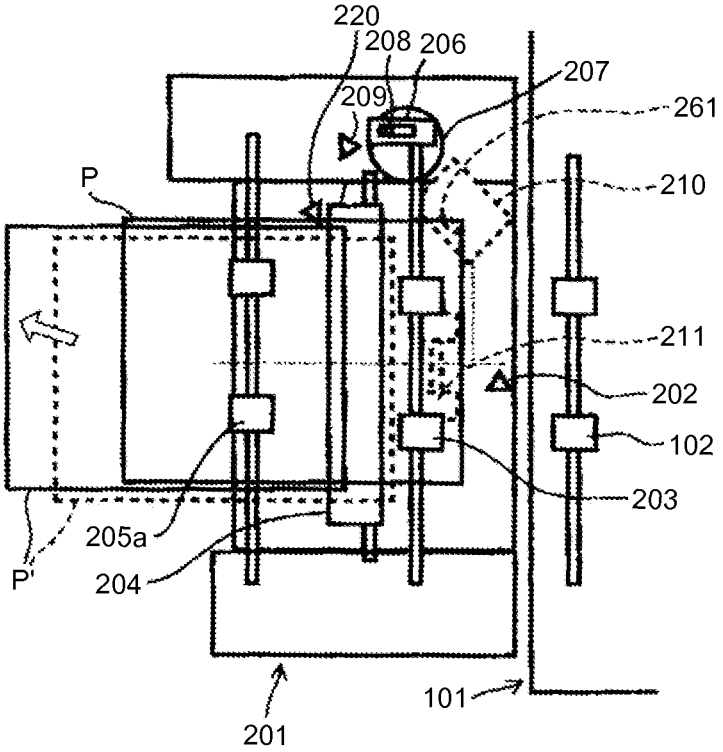
FIG. 14A is a plan view illustrating a state of inside of the paper postprocessing apparatus receiving a subsequent paper sheet.
Figure 14B:
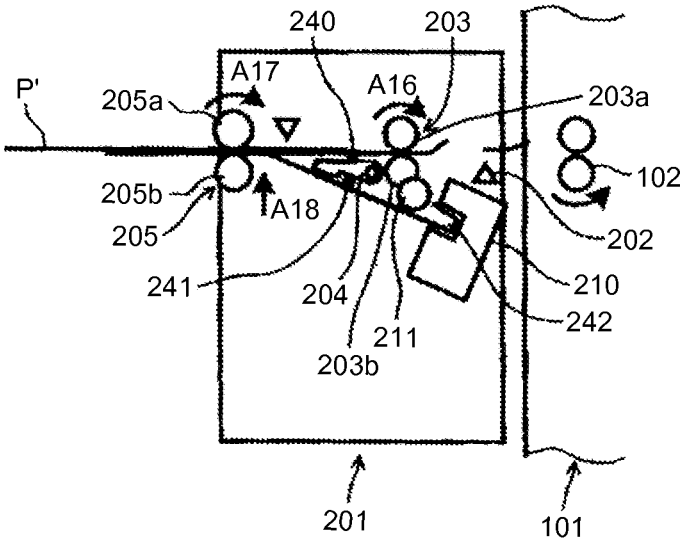
FIG. 14B is a front view illustrating the state of the inside of the paper postprocessing apparatus receiving the subsequent paper sheet.

Next, in FIG. 14A and FIG. 14B, at a timing at which a leading end of the subsequent paper sheet P' passes a position opposite to the paper ejection drive roller 205*a*, the paper ejection driven roller 205*b* is moved in a direction of an arrow A18 in FIG. 14B.

Thereby, the subsequent paper sheet P' is held between the paper ejection drive roller 205*a* and paper ejection driven roller 205*b* via the paper sheet P on the binding process tray 243 to form the conveyance nip. By the formation of the conveyance nip, a conveyance force is placed on the paper sheet P on the binding process tray 243.

However, the paper sheet P on the binding process tray 243 is pressed onto the binding process tray 243 with the strong force by the bifurcating claw 204. Therefore, the paper "P" will not be conveyed by the conveyance force at the conveyance nip between the paper ejection drive roller 205*a* and the paper ejection driven roller 205*b*. As a result, at the conveyance nip, only the subsequent paper sheet P' is conveyed while rubbing against the paper sheet P on the binding process tray 243.

As described, after the conveyance nip is generated again, the same operations as those described by using FIG. 11A to FIG. 13B are repeated, and paper sheets are loaded on the binding process tray 243. For subsequent paper sheets P", . . . , the operations as described in FIG. 11A to FIG. 14B are repeated, the paper sheets are subsequently moved to their targeted positions and overlapped onto the paper sheets on the binding process tray 243 to thereby be stacked into a paper sheet bundle PS in an aligned state.

Figure 15A:
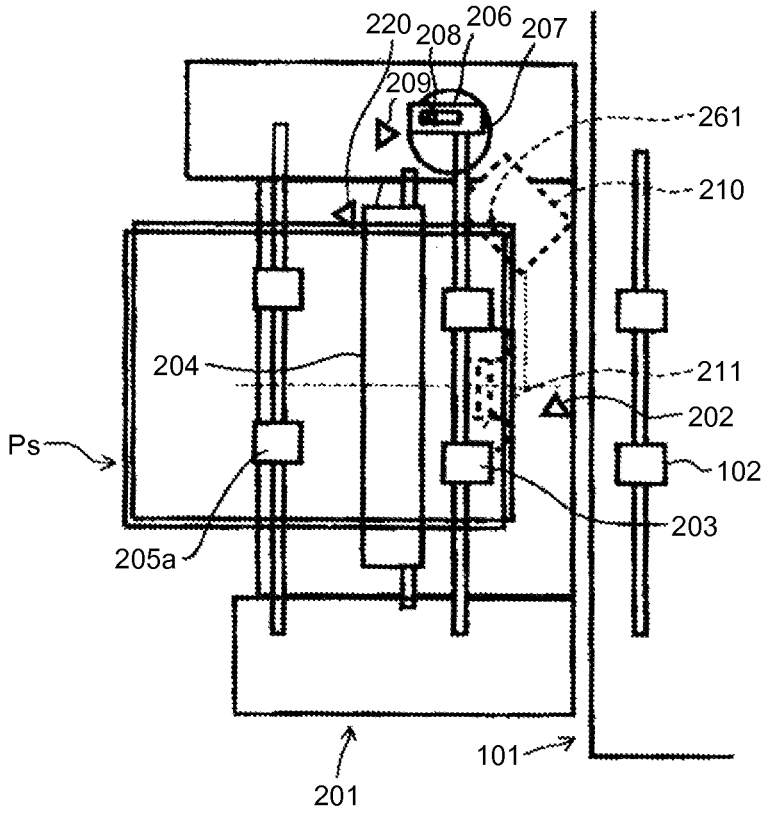
FIG. 15A is a plan view illustrating a state of inside of the paper postprocessing apparatus after a process of aligning a paper sheet bundle is completed and before a binding process is started.
Figure 15B:
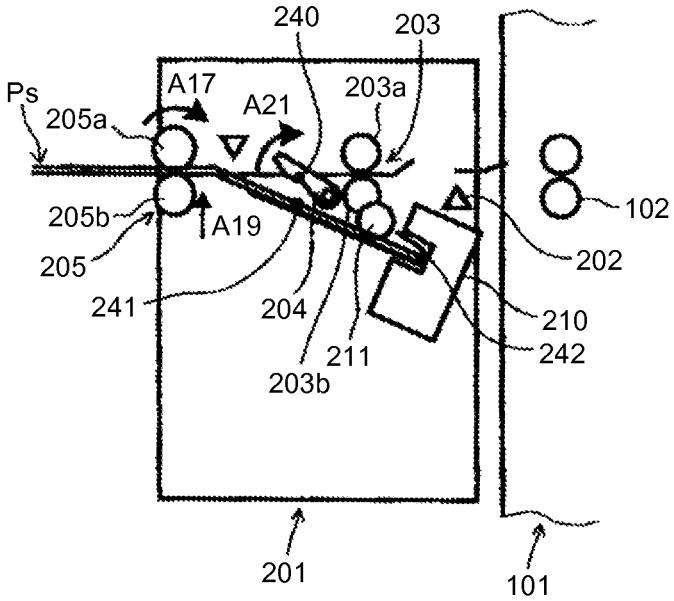
FIG. 15B is a front view illustrating the state of the inside of the paper postprocessing apparatus after the process of aligning the paper sheet bundle is completed and before the binding process is started.

Next, in FIG. 15A and FIG. 15B, when an operation of overlaying the last paper sheet on the paper sheet bundle PS in the aligned state is completed, the paper ejection driven roller 205*b* is moved in a direction of an arrow A18 in FIG. 15B. Thereby, the paper sheet bundle PS is held between the paper ejection drive roller 205*a* and the paper ejection driven roller 205*b* to form the conveyance nip.

Next, the paper ejection drive roller 205*a* rotates in a direction of an arrow A17 in FIG. 15B (clockwise direction) and stops, to convey the paper sheet bundle PS by a certain amount. By this conveyance by the pair of paper ejection rollers, the bending caused upon the abutment of the tail ends of the paper sheets against the abutted surface 242 is able to be removed.

Thereafter, the bifurcating claw 204 rotates in a direction of an arrow A21 in FIG. 15B (clockwise direction) to change a direction of the distal end of the bifurcating claw 204, and the pressing force that has been placed on the paper sheet bundle PS is released.

Figure 16A:
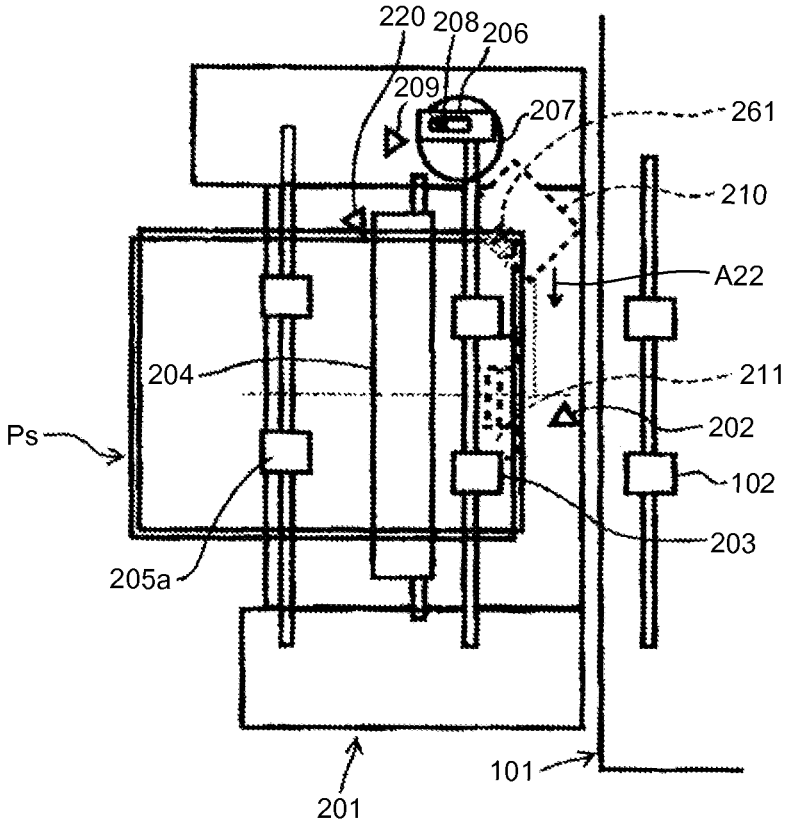
FIG. 16A is a plan view illustrating a state of inside of the paper postprocessing apparatus when ejection of the paper sheet bundle on which the binding process has been completed is started.
Figure 16B:
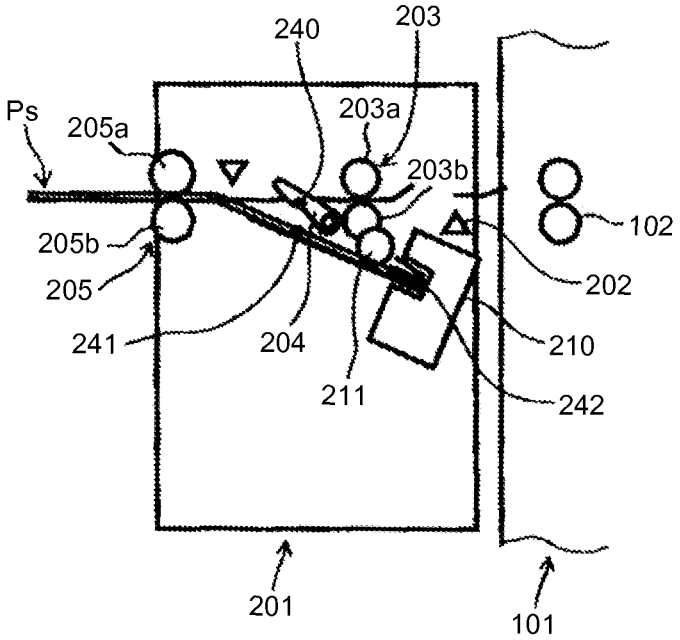
FIG. 16B is a front view illustrating the state of the inside of the paper postprocessing apparatus when the ejection of the paper sheet bundle on which the binding process has been completed is started.

Next, in FIG. 16A and FIG. 16B, the binding implement 210 is moved in a direction of an arrow A22 in FIG. 16A by a distance at which a position of the tooth dies 261 of the binding implement 210 matches a processing position of the paper sheet bundle PS, and is stopped. Thereby, the position of the tooth dies 261 of the binding implement 210 in a paper width direction is aligned with the processing position of the paper sheet bundle PS (binding position).

In this embodiment, without moving the binding implement 210 in the direction of the arrow A22, the position of the tooth dies 261 of the binding implement 210 (see FIG. 7) and the processing position (binding position) of the paper sheet bundle PS are aligned with each other.

When the alignment of the binding position of the paper sheet bundle PS is finished, by turning the drive motor 265 (see FIG. 7) of the binding implement 210 ON and pressurizing and drawing the paper sheet bundle PS by the tooth dies 261, fibers of the respective paper sheets P are entwined with one another, the paper sheets are combined, and the paper sheet bundle PS is thus bound.

Figure 17A:
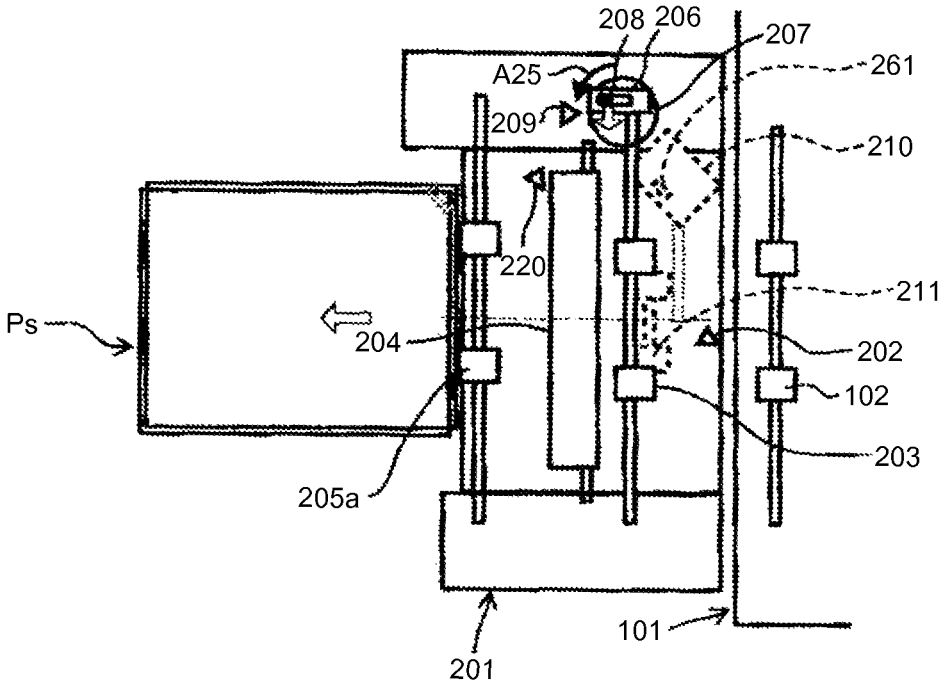
FIG. 17A is a plan view illustrating a state of inside of the paper postprocessing apparatus ejecting the paper sheet bundle on which the binding process has been completed.
Figure 17B:
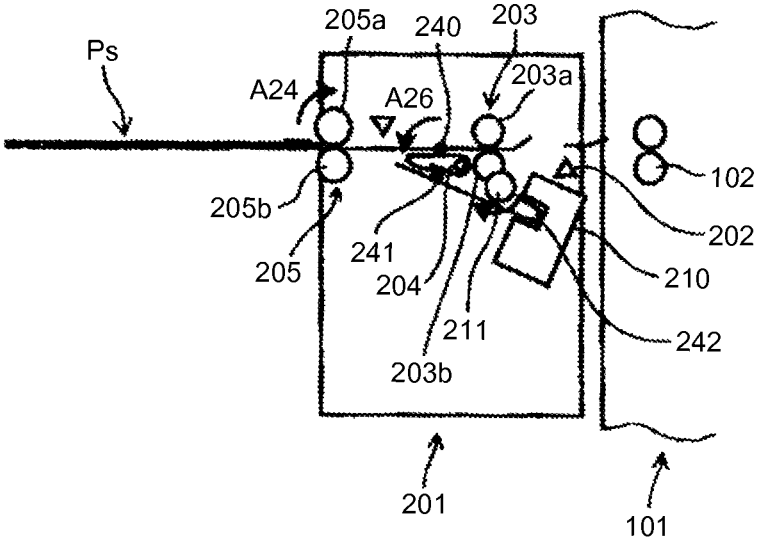
FIG. 17B is a front view illustrating the state of the inside of the paper postprocessing apparatus ejecting the paper sheet bundle on which the binding process has been completed.

Next, in FIG. 17A and FIG. 17B, the paper ejection drive roller 205*a* is rotated in a direction of an arrow A24 in the figure and the bound paper sheet bundle PS is ejected. After the ejection of the paper sheet bundle PS, the shift cam 207 is rotated in a direction of an arrow A25 in FIG. 17A and returned to the home position.

Further, the bifurcating claw 204 is turned in a direction of an arrow S26 in FIG. 17B and returned to the home position. Accordingly, operations of the binding process are completed.

Figure 18A:
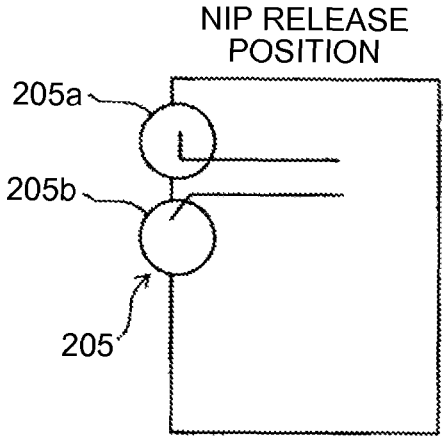
FIG. 18A is a diagram illustrating a nip release position.
Figure 18B:
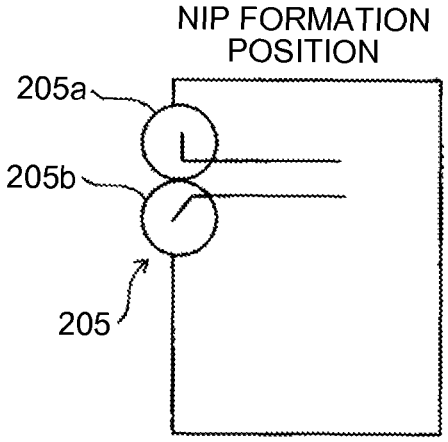
FIG. 18B is a diagram illustrating a nip formation position.

FIG. 18A is a diagram illustrating a nip release position and FIG. 18B is a diagram illustrating a nip formation position, when the pair of paper ejection rollers 205 form a paper ejection unit.

The pair of paper ejection rollers 205, which are a conveying unit that conveys the paper sheets fed from the image forming apparatus 101 to the binding process tray 243 and ejects the postprocessed paper sheet bundle PS on the binding process tray 243 to the paper ejection tray, are formed of the paper ejection drive roller 205*a* and the paper ejection driven roller 205*b*.

The paper ejection driven roller 205*b* is configured to be able to contact with and separate from the paper ejection drive roller 205*a* by moving up and down. Specifically, the paper ejection driven roller 205*b* is configured to take a "nip release position", which is a position separated from the paper ejection drive roller 205*a* as illustrated in FIG. 18A and a "nip formation position" forming the conveyance nip by contacting the paper ejection drive roller 205*a* as illustrated in FIG. 18B.

By using FIG. 19A to FIG. 19F, a conventional shift operation will be described.

Figures 19A, 19B, 19C, 19D, 19E, 19F:
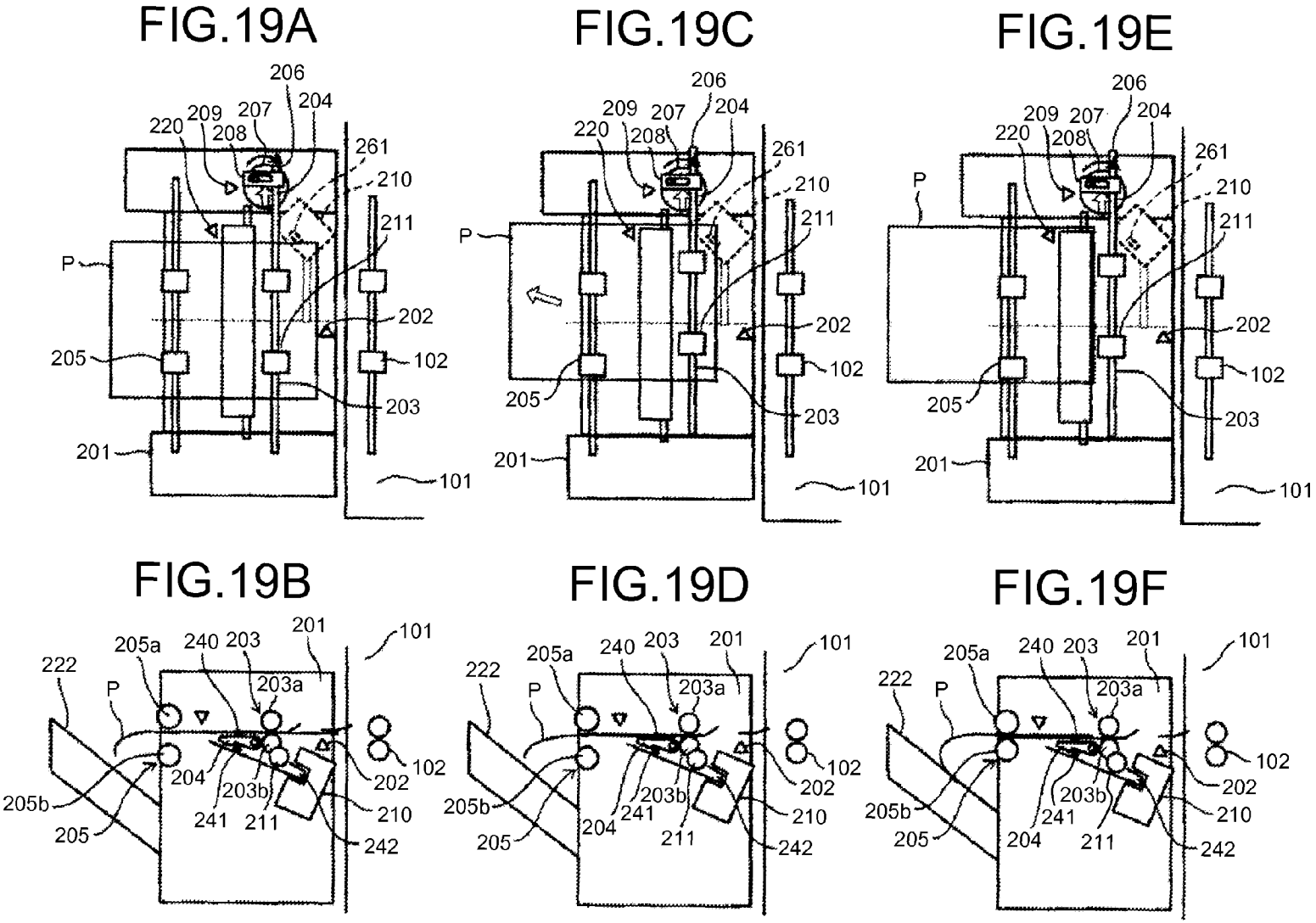
FIG. 19A to FIG. 19F are a diagram to be used in describing a conventional shift operation.

In the conventional shift operation, as illustrated in FIG. 19A and FIG. 19B, after separating the paper ejection driven roller 205*b* from the paper ejection drive roller 205*a*, a paper sheet P is conveyed in a state in which the pair of paper ejection rollers 205 are separated.

Therefore, the leading end side of the paper sheet P is not held by the pair of paper ejection rollers 205 and the paper sheet P is conveyed in a state in which only the tail end side of the paper sheet P is held between the pair of inlet rollers 203, and thus, the leading end side of the paper sheet P is not provided with firmness.

As illustrated in FIG. 19C and FIG. 19D, when the paper sheet P is conveyed further while shifting the paper sheet P by the pair of inlet rollers 203 in the state in which the pair of paper ejection rollers 205 are separated, the leading end of the paper sheet P not provided with firmness hangs down towards the paper ejection tray 222.

After the shift operation of the paper sheet P by the pair of inlet rollers 203 is completed, as in FIG. 19E and FIG. 19F, the paper ejection driven roller 205*b* contacts the paper ejection driver roller 205*a* to form the conveyance nip and the pair of paper ejection rollers convey the paper sheet P while holding the paper sheet P therebetween.

However, since the paper sheet P is conveyed by the pair of paper ejection rollers 205 in the state in which the leading end of the paper sheet P not provided with firmness hangs down, curling may occur at the paper sheet leading end side when the paper sheet leading end contacts the paper ejection tray.

Therefore, in this embodiment, the control unit provided in the paper sheet postprocessing apparatus 201 functions as a paper sheet information acquiring unit that acquires paper sheet information, such as a paper sheet size or a paper thickness, transmitted from the image forming apparatus 101. The timing of the contacting and separating operation of the pair of paper ejection rollers 205 and the shift operation of the paper sheet P by the pair of inlet rollers 203 is able to be changed by the control unit of the paper sheet postprocessing apparatus 201, based on the paper sheet information from the image forming apparatus 101.

The paper sheet information transmitted from the image forming apparatus 101 to the paper sheet postprocessing apparatus 201 may be, for example, obtained by a known method, such as by inputting by a user from an operation panel provided in the image forming apparatus 101 or by detecting a paper sheet by a sensor.

Further, the control unit of the image forming apparatus 101 may be configured to be able to change, based on the paper sheet information, the timing of the contacting and separating operation of the pair of paper ejection rollers 205 and the shift operation of the paper sheet P by the pair of inlet rollers 203.

By using FIG. 1A to FIG. 1F, an example of the shift operation according to this embodiment will be described.

A case in which, from the paper sheet size, as the information of the paper sheet P, a paper sheet length, which is a length of the paper sheet P in the conveyance direction thereof, is longer than a predetermined length set beforehand, will be described. In other words, a case in which the paper sheet length, which is the length of the paper sheet P in the conveyance direction, is a length such that the leading end of the paper sheet can contact a paper sheet loading surface of the paper ejection tray 222 in a state in which the paper sheet P is held between the pair of inlet rollers 203, will be described.

Figures 1A, 1B, 1C, 1D, 1E, 1F:
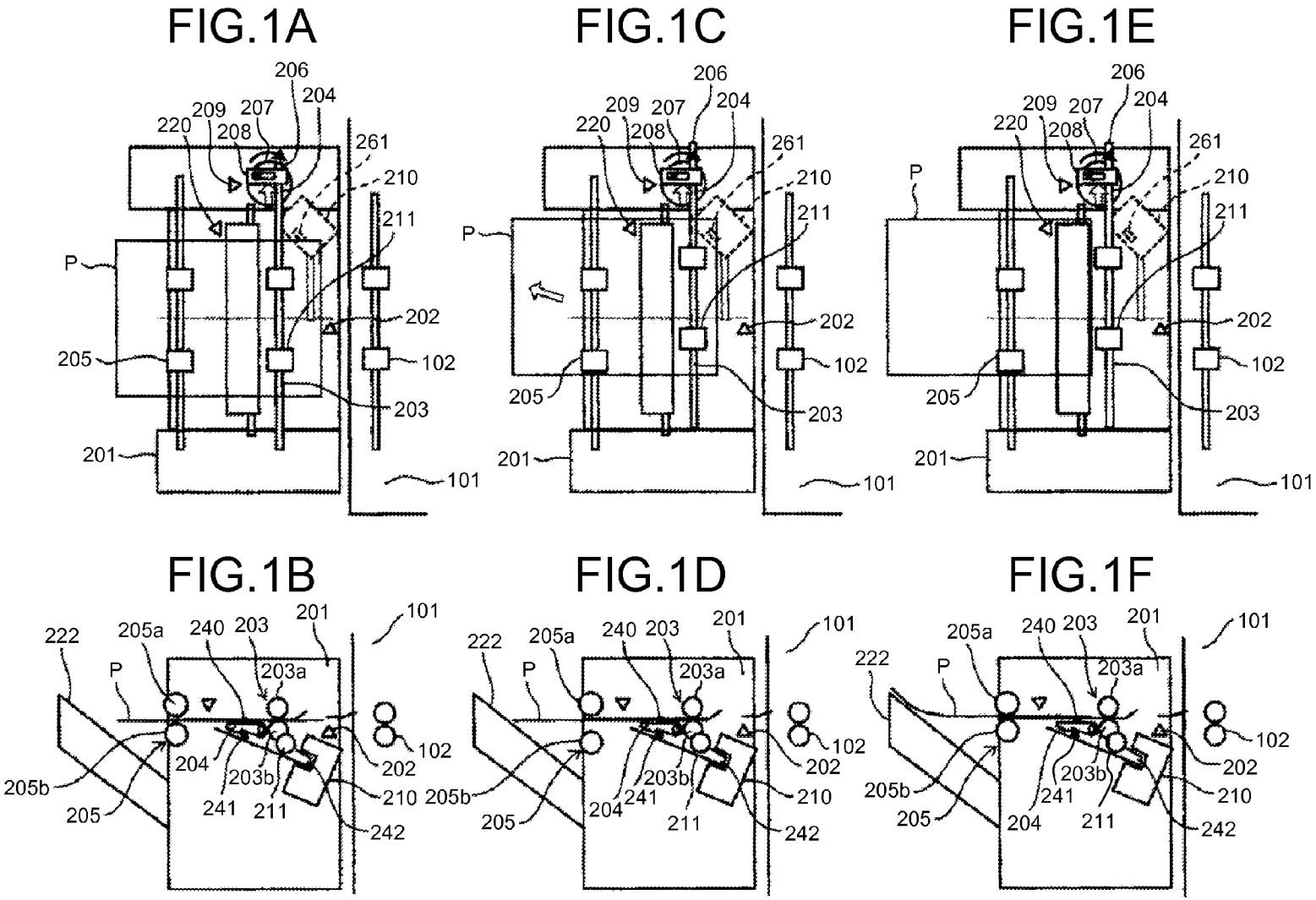
FIG. 1A to FIG. 1F are diagrams to be used in describing an example of a shift operation in an embodiment.

In the shift operation according to this embodiment, as illustrated in FIG. 1A and FIG. 1B, in a state in which the paper sheet P received from the image forming apparatus 101 is held between the pair of inlet rollers 203 and between the pair of paper ejection rollers 205, the paper sheet P is conveyed until the leading end of the paper sheet P reaches a side downstream from the pair of paper ejection rollers 205.

Thus, since, not only because the tail end side of the paper sheet P is held between the pair of inlet rollers 203, but also because the paper sheet P is conveyed in a state in which the leading end side of the paper sheet P is held between the pair of paper ejection rollers 205, as illustrated in FIG. 1B, the leading end side of the paper sheet P is provided with firmness.

As illustrated in FIG. 1C and FIG. 1D, immediately before start of the shift operation of the paper sheet P by the pair of inlet rollers 203, the paper ejection driven roller 205*b* is separated from the paper ejection drive roller 205*a* to take the nip release position and cause the pair of paper ejection rollers 205 to be separated.

When this happens, since there is firmness at the paper sheet leading end side, conveyance is carried out with the leading end of the paper sheet P hardly hanging down towards the paper ejection tray 222, and a landing spot upon contact of the paper sheet leading end with the paper sheet loading surface of the paper ejection tray 222 is more downstream than the conventional one.

The paper sheet P is further conveyed while shifting the paper sheet P by the pair of inlet rollers 203, still in the state in which the pair of paper ejection rollers 205 are separated. Then, as illustrated in FIG. 1E and FIG. 1F, the paper sheet leading end moves downstream along the paper sheet loading surface of the paper ejection tray 222, and without occurrence of curling at the paper sheet leading end side, the paper sheet P is ejected onto the paper ejection tray 222.

If, from the paper sheet size as the paper sheet information of the paper sheet P, the paper sheet length is shorter than the predetermined length, the timing of the contacting and separating operation of the pair of paper ejection rollers 205 and the timing of the shift operation of the paper sheet P by the pair of inlet rollers 203 are changed as follows.

In other words, if the paper sheet length, which is the length of the paper sheet P in the conveyance direction, is a length such that the paper sheet leading end cannot contact the paper sheet loading surface of the paper ejection tray 222, the timing of the contacting and separating operation and the timing of the shift operation are changed as follows.

The paper sheet P received from the image forming apparatus 101 is conveyed in a state of being held between the pair of inlet rollers 203, and before the paper sheet leading end reaches the pair of paper ejection rollers 205, the shift operation of the paper sheet P by the pair of inlet rollers 203 is completed.

Then, by holding and conveying the paper sheet P, on which the shift operation has been completed, between and by the pair of paper ejection rollers 205 from the leading end thereof, the paper sheet P is ejected to the paper ejection tray 222 in a state in which the paper sheet leading end side is provided with firmness. Thereby, as described above, the paper sheet leading end moves downstream along the paper sheet loading surface of the paper ejection tray 222, and without occurrence of curling at the paper sheet leading end side, the paper sheet P is ejected onto the paper ejection tray 222. Therefore, failure in the loading of the paper sheet P, on which the shift operation has been performed, onto the paper ejection tray 222 is able to be suppressed.

Further, if, from the paper thickness as the paper sheet information of the paper sheet P, the thickness of the paper sheet P is of a thick paper thicker than a predetermined paper thickness set beforehand, the timing of the contacting and separating operation of the pair of paper ejection rollers 205 and the timing of the shift operation of the paper sheet P by the pair of inlet rollers 203 are changed as follows.

That is, in the state in which the pair of paper ejection rollers 205 are separated, the paper sheet P received from the image forming apparatus 101 is conveyed while being held between the pair of inlet rollers 203.

When this happens, the leading end side of the paper sheet P is not held by the pair of paper ejection rollers 205, and only the tail end side of the paper sheet P is held between the pair of inlet rollers 203, but because the paper sheet P is of thick paper, the paper sheet P is conveyed with the paper sheet leading end side being firm.

The paper sheet P is further conveyed while shifting the paper sheet P by the pair of inlet rollers 203, still in the state in which the pair of paper ejection rollers 205 are separated. After the shift operation of the paper sheet P by the pair of inlet rollers 203 is completed, the paper sheet P is conveyed while being held between the pair of inlet rollers 203 and between the pair of paper ejection rollers 205.

Thereby, the paper sheet P is ejected to the paper ejection tray 222, in the state in which the paper sheet leading end side is provided with firmness, and as described above, the paper sheet leading end moves downstream along the paper sheet loading surface of the paper ejection tray, and the paper sheet P is ejected onto the paper ejection tray 222 without occurrence of curling at the paper sheet leading end side. Therefore, failure in the loading of the paper sheet P, on which the shift operation has been performed, onto the paper ejection tray 222 is able to be suppressed.

That is, if the paper sheet P is of thick paper, in a state in which the paper sheet leading end is positioned downstream from the pair of paper ejection rollers 205 and is not in contact with the paper sheet loading surface of the paper ejection tray 222, the shift operation of the paper sheet P by the pair of inlet rollers 203 is performed.

Thereby, as compared to a case in which a shift operation of the paper sheet P is performed in a state in which the paper sheet leading end is in contact with the paper sheet loading surface of the paper ejection tray 222, conveyance resistance of the paper sheet P upon the shift operation is able to be reduced, and occurrence of malfunction, such as skew, is able to be suppressed. Therefore, failure in the loading of the paper sheet P, on which the shift operation has been performed, onto the paper ejection tray 222 is able to be suppressed.

Modified Example

Figure 20A:
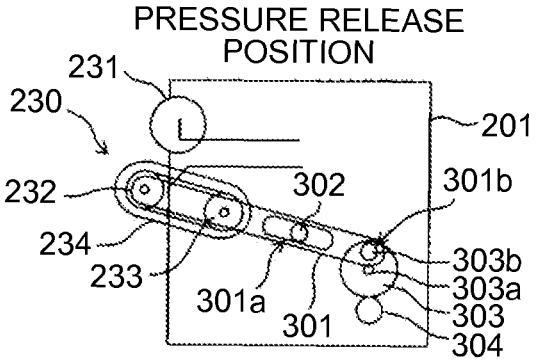
FIG. 20A is a diagram illustrating a pressure release position.
Figure 20B:
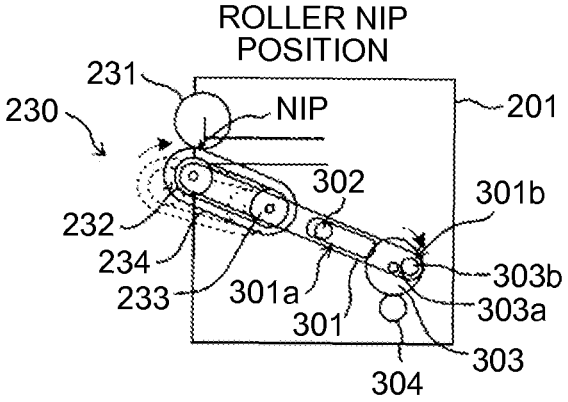
FIG. 20B is a diagram illustrating a roller nip position.
Figure 20C:
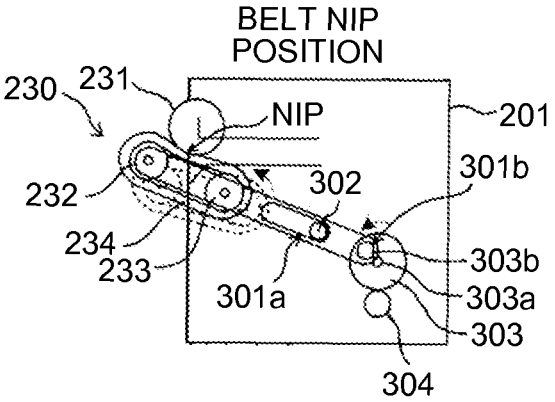
FIG. 20C is a diagram illustrating a belt nip position.

FIG. 20A to FIG. 20C are schematic diagrams of a paper sheet postprocessing apparatus 201 according to a modified example. In detail, FIG. 20A is a diagram illustrating a pressure release position, FIG. 20B is a diagram illustrating a roller nip position, and FIG. 20C is a diagram illustrating a belt nip position. In FIG. 20A to FIG. 20C, a configuration other than that for ejecting a paper sheet P to outside of the apparatus is similar to the configuration of the paper sheet postprocessing apparatus 201 illustrated in FIG. 4 and the like, and illustration thereof is omitted.

The paper sheet postprocessing apparatus 201 according to the modified example has a paper ejection belt mechanism 230 configured of a downstream roller 232, an upstream roller 233, and a conveyance belt 234 wound over the circumferences of these two rollers. This paper ejection belt mechanism 230 conveys a paper sheet P by holding the paper sheet P in a nip formed by causing a paper ejection drive roller 231 provided at a position opposite to the conveyance belt 234 to contact with the conveyance belt 234.

In the paper ejection belt mechanism 230, a rotating shaft of the upstream roller 233 is held by a holder 301, and by this holder 301 swinging, the paper ejection belt mechanism 230 also swings, and a position of the nip formed of the conveyance belt 234 and the paper ejection drive roller 231 is changed.

At the center of the holder 301 in its longitudinal direction, a long hole 301*a* is formed, and a fixed axis 302 fixed to an apparatus main body is fitted into this long hole 301*a*. Further, at an end portion at an opposite side of the paper ejection belt mechanism 230 in the longitudinal direction of the holder 301, a pin hole 301*b*, into which a pin 303*b* fixed to a cam 303 described later is fitted, is formed. A diameter of this pin hole 301*b* is a little larger than a diameter of the pin 303*b* and has looseness in a state in which the pin 303*b* is fitted into the pin hole 301*b*.

The cam 303 fixed, on a side face of which the pin 303*b* is fixed so as to stand up, is rotatable by a rotational drive force from a paper ejection pressurizing motor 304, around a cam rotation shaft 303*a* rotatably supported by the apparatus main body. By the cam 303 rotating around the cam rotation shaft 303*a* and the pin 303*b* rotating around the cam rotation shaft 303*a*, the holder 301 moves in association therewith and the holder 301 swings.

<Pressure Release Position>

As illustrated in FIG. 20A, if the pin 303*b* of the cam 303 is positioned above the cam rotation shaft 303*a* in the figure, a cam 303 side of the holder 301 is pushed up with the fixed axis 302 being at the center, and on the contrary, a paper ejection belt mechanism 230 side of the holder 301 is pushed down with the fixed axis 302 being at the center. Thereby, the conveyance belt 234 and the paper ejection drive roller 231 are separated to release the nip.

<Roller Nip Position>

If the cam 303 rotates clockwise in the figure from the cam position at the pressure release position and the pin 303*b* of the cam 303 is positioned to the right side in the figure with respect to the cam rotation shaft 303*a*, the holder 301 moves to the right side in the figure with respect to the fixed axis 302. What is more, as much as the rotation of the cam 303, the pin 303*b* goes down to a position lower than the pin position at the pressure release position.

As a result, the paper ejection belt mechanism 230 side of the holder 301 is pushed up, and the conveyance belt 234 contacts with the paper ejection drive roller 231 on a peripheral surface of the downstream roller 232 to form the nip. As described, since the nip is formed by the conveyance belt 234 and the paper ejection drive roller 231 on the peripheral surface of the downstream roller 232, a structure similar to the normal structure formed by contacting rollers is provided, and excellent conveying performance thereby is achieved.

<Belt Nip Position>

If the cam 303 rotates anticlockwise in the figure from the cam position at the pressure release position, and the pin 303*b* of the cam 303 is, as illustrated in FIG. 20C, positioned at a left side in the figure with respect to the cam rotation shaft 303*a*, the holder 301 moves to a left side in the figure with respect to the fixed axis 302. What is more, as much as the rotation of the cam 303, the pin 303*b* goes down to a position lower than the pin position at the pressure release position.

As a result, the paper ejection belt mechanism 230 side of the holder 301 is pushed up and at an approximate intermediate position between the downstream roller 232 and the upstream roller 233, the conveyance belt 234 and the paper ejection drive roller 231 contact each other to form the nip. Therefore, at a position opposite to the paper ejection drive roller 231, a space with nothing other than the conveyance belt 234 is produced (there is no rigid body like a roller).

Thus, the conveyance belt 234 that has contacted the paper ejection drive roller 231 is bent, an amount of conveyance belt 234 wound around a peripheral surface of the paper ejection drive roller 231 is increased, and an area of the nip is increased. Accordingly, even if a pressurizing force is set at a large pressurizing force that is able to keep the conveying performance by the increase in the area of the nip, since the area of the nip is large, "contact pressure" is able to be reduced, and a mark caused by rubbing is able to be suppressed from being formed on the paper sheet P passing the nip or on an image formed on that paper sheet P.

For appropriate use between the roller nip position and the belt nip position, for example, the belt nip position is used when rubbing among the paper sheets occurs upon conveyance and the roller nip position is used when the rubbing among the paper sheets does not occur.

Specifically, the belt nip position is a position to be used in conveying a second paper sheet and any sheet thereafter, after the first paper sheet has been abutted against the binding process tray in the binding mode. The reason for using it for only the second paper sheet and any sheet thereafter is because, by sliding and conveying the second paper sheet and any sheet thereafter with the paper sheet that is already on the binding process tray, a rubbed mark caused by rubbing among the paper sheets may be placed on the paper sheets or on the images thereon. Therefore, in order to reduce such rubbed marks, by taking the belt nip position, the nip area is enlarged to decrease the contact pressure.

For example, the belt nip position is taken, at a timing at which the leading end of the subsequent paper sheet P' as described by using FIG. 14A and FIG. 14B for the configuration of the pair of paper ejection rollers has passed the position opposite to the paper ejection drive roller 231 in the paper sheet postprocessing apparatus 201 of this modified example. Thereby, the paper sheet P is held between the paper ejection drive roller 231 and the conveyance belt 234. Thereafter, the paper sheet P is conveyed until the paper sheet tail end is positioned downstream from the bifurcating claw 204, and thereafter, the paper ejection drive roller 231 is counter-rotated, to maintain the belt nip position until the paper sheet tail end is abutted against the abutted surface 242 of the binding process tray 243.

On the contrary, upon ejection of a paper sheet bundle after the paper sheet bundle has been subjected to the binding process, since rubbing among the paper sheet does not occur, the roller nip position is set between the paper ejection drive roller 231 and the conveyance belt 234 and the paper sheet bundle is held therebetween and conveyed thereby and is ejected. The roller nip position is a position that is used not only upon the ejection of the paper sheet bundle, but also upon conveyance of the first paper sheet in the binding mode, and upon the straight mode and the shift mode.

Figure 21:
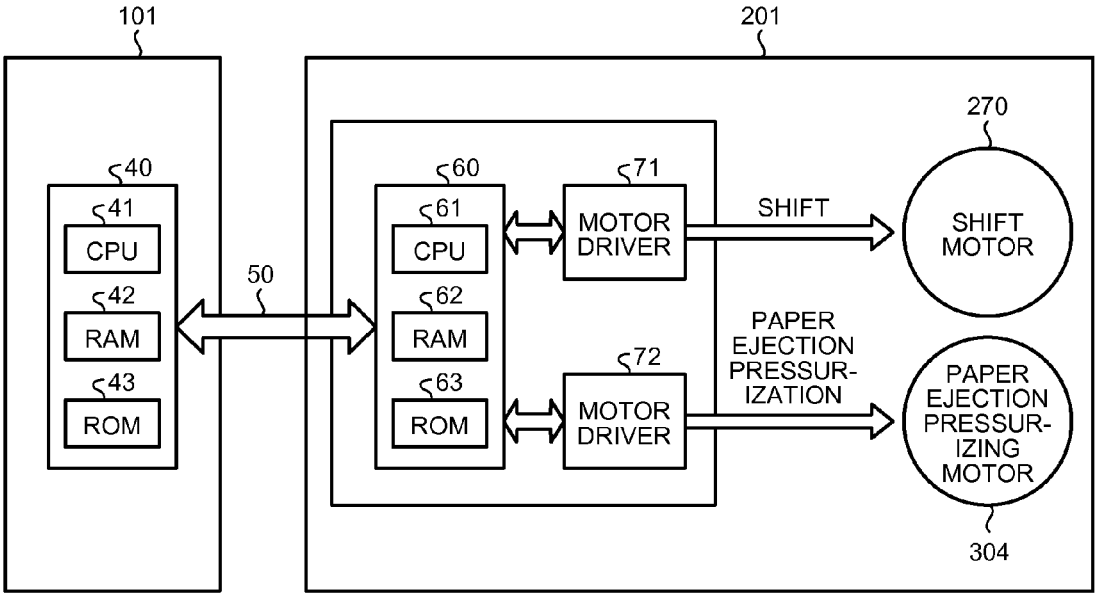
FIG. 21 is a block diagram illustrating an electric connection between an image forming apparatus and the paper sheet postprocessing apparatus.

FIG. 21 is a block diagram illustrating an electrical connection between the image forming apparatus 101 and the paper sheet postprocessing apparatus 201.

In the image forming apparatus 101, a control unit 40 having a CPU 41, a RAM 42, a ROM 43, and the like is provided. Further, in the paper sheet postprocessing apparatus 201, a control unit 60 having a CPU 61, a RAM 62, a ROM 63, and the like is provided. The control unit 40 of the image forming apparatus 101 and the control unit 60 of the paper sheet postprocessing apparatus 201 are connected to each other by a communication cable 50, and notification of the paper sheet information (size or paper thickness) from the image forming apparatus 101 to the paper sheet postprocessing apparatus 201 is performed.

According to the paper sheet information notified from the image forming apparatus 101, via a motor driver 71 and a motor driver 72, the control unit 60 controls a shift motor 270, which is a drive source for rotating the shift cam 207, and the paper ejection pressurizing motor 304, and changes a shift timing. As the shift motor 270 or the paper ejection pressurizing motor 304, a stepping motor may be used.

What has been described above is an example, and the present invention has a particular effect for each of the following modes.

(Mode A)

A sheet processing apparatus, such as the paper sheet postprocessing apparatus 201, including: a loading tray, such as the paper ejection tray 222, on which a sheet, such as the paper sheet P, is loaded on a sheet loading surface thereof, such as the paper sheet loading surface; a pair of ejection rollers, such as the pair of paper ejection rollers 205, which eject the sheet to the loading tray and in which a pair of roller members, such as the paper ejection drive roller 205*a* and paper ejection driven roller 205*b*, are configured to be able to contact with and separate from each other; a pair of shift rollers, such as the pair of inlet rollers 203, which are provided upstream of the pair of ejection rollers in a sheet conveyance direction, are movable in a sheet width direction that is a direction perpendicular to the sheet conveyance direction, conveys the sheet towards the loading tray, and performs a shift operation of shifting the sheet to a different position in the sheet width direction; and a control unit that performs control of changing, based on sheet information, a shift operation timing by the pair of shift rollers and a contacting and separating timing of the pair of ejection rollers. Accordingly, as described with respect to the embodiment, regardless of a type of the sheets, failure in the loading of the sheet that has been subjected to the shift operation is able to be suppressed.

(Mode B)

In the mode A, the sheet information is a sheet size, and if a length of the sheet in the conveyance direction is a length such that a sheet leading end can contact the sheet loading surface in a state in which the sheet is held between the pair of shift rollers, the sheet is conveyed until the sheet leading end contacts the loading tray in a state in which the sheet is held between and conveyed by the pair of shift rollers and the pair of ejection rollers, and thereafter, the shift operation of the sheet by the pair of shift rollers is performed after the pair of ejection rollers are separated from each other. Accordingly, as described with respect to the embodiment, the sheet leading end contacts the sheet loading surface in a state in which the sheet leading end side is provided with firmness. Therefore, the leading end of the sheet that has been subjected to the shift operation thereafter is able to be moved along the sheet loading surface, and the sheet is able to be ejected onto the loading tray without occurrence of curling at the sheet leading end side.

(Mode C)

In the mode A, the sheet information is a sheet size, and if a length of the sheet in the sheet conveyance direction is a length such that a sheet leading end cannot contact the sheet loading surface in a state in which the sheet is held between the pair of shift rollers, the sheet is held between and conveyed by the pair of shift rollers and before the sheet leading end reaches the pair of ejection rollers, the shift operation of the sheet by the pair of shift rollers is completed, and the sheet on which the shift operation has been completed is held between and conveyed by the pair of ejection rollers. Accordingly, as described with respect to the embodiment, the sheet that has been subjected to the shift operation in a state in which the sheet leading end side has firmness is able to be ejected to the loading tray and the sheet is able to be ejected onto the loading tray without occurrence of curling at the sheet leading end side.

(Mode D)

In the mode A, the sheet information is a thickness of the sheet, and if the sheet is thicker than a predetermined thickness set beforehand, in a state in which the pair of ejection rollers are separated from each other, the sheet is held between and conveyed by the pair of shift rollers, and when a sheet distal end is positioned downstream from the pair of ejection rollers in the sheet conveyance direction, the shift operation of the sheet by the pair of shift rollers is performed. Accordingly, as described with respect to the embodiment, without occurrence of curling at the sheet leading end side, the sheet that has been subjected to the shift operation is able to be ejected onto the loading tray, conveyance resistance upon the shift operation is able to be reduced and occurrence of malfunction, such as skew, is able to be suppressed.

(Mode E)

In an image forming system including an image forming apparatus that forms an image on a sheet and a sheet processing apparatus that performs a predetermined process on the sheet on which the image has been formed by the image forming apparatus; as the sheet processing apparatus, the sheet processing apparatus according to the mode A, mode B, mode C, or mode D is used. Accordingly, as described with respect to the embodiment, regardless of a type of the sheet, failure in loading of sheet that has been subjected to the shift operation is able to be suppressed.

According to an embodiment, there is an effect that failure in loading of sheets that have been subjected to a shift operation is able to be suppressed regardless of a type of the sheets.

What is claimed is:

1. A sheet processing apparatus, comprising:

a loading tray on which a sheet is loaded on a sheet loading surface thereof;

a pair of ejection rollers configured to eject the sheet to the loading tray and, to contact with and separate from each other;

a pair of shift rollers upstream of the pair of ejection rollers in a sheet conveyance direction, configured to convey the sheet towards the loading tray, and to move in a sheet width direction that is perpendicular to the sheet conveyance direction to perform a shift operation of the sheet to a different position in the sheet width direction; and a control unit configured to receive sheet information of the sheet, and to adjust a timing of the shift operation and a timing of contacting and separating the pair of ejection rollers based on the sheet information.

2. The sheet processing apparatus according to claim 1, wherein the sheet information is a sheet size, and if a length of the sheet in the sheet conveyance direction is a length such that a sheet leading end can contact the sheet loading surface in a state in which the sheet is held between the pair of shift rollers, the sheet is conveyed until the sheet leading end contacts the loading tray in a state in which the sheet is held and conveyed between and by the pair of shift rollers and between and by the pair of ejection rollers, and thereafter, the shift operation of the sheet by the pair of shift rollers is performed after the pair of ejection rollers are separated from each other.

3. The sheet processing apparatus according to claim 1, wherein the sheet information is a sheet size, and if a length of the sheet in the sheet conveyance direction is a length such that a sheet leading end cannot contact the sheet loading surface in a state in which the sheet is held between the pair of shift rollers, the sheet is held between and conveyed by the pair of shift rollers and before the sheet leading end reaches the pair of ejection rollers, the shift operation of the sheet by the pair of shift rollers is completed, and the sheet on which the shift operation has been completed is held between and conveyed by the pair of ejection rollers.

4. The sheet processing apparatus according to claim 1, wherein the sheet information is a thickness of the sheet, and if the sheet is thicker than a predetermined thickness set beforehand, in a state in which the pair of ejection rollers are separated from each other, the sheet is held between and conveyed by the pair of shift rollers, and when a sheet leading end is positioned downstream from the pair of ejection rollers in the sheet conveyance direction, the shift operation of the sheet by the pair of shift rollers is performed.

5. An image forming system, comprising:

an image forming apparatus that forms an image on a sheet; and a sheet processing apparatus that performs a predetermined process on the sheet on which the image has been formed by the image forming apparatus, wherein the sheet processing apparatus is the sheet processing apparatus according to claim 1.

* * * * *